US008065141B2

(12) United States Patent
Maeda

(10) Patent No.: US 8,065,141 B2
(45) Date of Patent: Nov. 22, 2011

(54) APPARATUS AND METHOD FOR PROCESSING SIGNAL, RECORDING MEDIUM, AND PROGRAM

(75) Inventor: Yuuji Maeda, Tokyo (JP)

(73) Assignee: Sony Corporation, Tokyo (JP)

( * ) Notice: Subject to any disclaimer, the term of this patent is extended or adjusted under 35 U.S.C. 154(b) by 1124 days.

(21) Appl. No.: 11/844,784

(22) Filed: Aug. 24, 2007

(65) Prior Publication Data

US 2008/0082343 A1 Apr. 3, 2008

(30) Foreign Application Priority Data

Aug. 31, 2006 (JP) ..... 2006-236222

(51) Int. Cl.
*G10L 19/00* (2006.01)

(52) U.S. Cl. ..... 704/219; 704/205; 704/206; 704/207; 704/214; 704/217; 704/221; 704/222; 704/230; 704/258; 704/260; 704/265; 704/267; 375/326; 708/313; 702/69

(58) Field of Classification Search ..... 704/265, 704/221, 219, 205, 206, 207, 214, 217, 222, 704/230, 258, 260, 267; 375/326; 708/313; 702/69
See application file for complete search history.

(56) References Cited

U.S. PATENT DOCUMENTS

| | | | | | |
|---|---|---|---|---|---|
| 4,850,022 | A * | 7/1989 | Honda et al. | ..... | 704/207 |
| 4,985,923 | A * | 1/1991 | Ichikawa et al. | ..... | 704/222 |
| 5,054,072 | A * | 10/1991 | McAulay et al. | ..... | 704/207 |
| 5,305,421 | A * | 4/1994 | Li | ..... | 704/219 |
| 5,553,194 | A * | 9/1996 | Seza et al. | ..... | 704/221 |
| 5,699,483 | A * | 12/1997 | Tanaka | ..... | 704/219 |
| 5,740,320 | A * | 4/1998 | Itoh | ..... | 704/267 |
| 6,119,086 | A * | 9/2000 | Ittycheriah et al. | ..... | 704/267 |
| 6,226,661 | B1 * | 5/2001 | Savell | ..... | 708/313 |
| 6,298,322 | B1 * | 10/2001 | Lindemann | ..... | 704/222 |
| 6,377,915 | B1 * | 4/2002 | Sasaki | ..... | 704/206 |
| 6,549,587 | B1 * | 4/2003 | Li | ..... | 375/326 |
| 6,801,887 | B1 * | 10/2004 | Heikkinen et al. | ..... | 704/206 |
| 7,292,947 | B1 * | 11/2007 | Tabatabaei | ..... | 702/69 |
| 7,363,218 | B2 * | 4/2008 | Jabri et al. | ..... | 704/221 |
| 7,565,286 | B2 * | 7/2009 | Gracie et al. | ..... | 704/217 |
| 2001/0032079 | A1 * | 10/2001 | Okutani et al. | ..... | 704/258 |
| 2002/0069052 | A1 * | 6/2002 | Chen | ..... | 704/230 |
| 2004/0039566 | A1 * | 2/2004 | Hutchison et al. | ..... | 704/214 |
| 2004/0073428 | A1 * | 4/2004 | Zlokarnik et al. | ..... | 704/260 |
| 2005/0044471 | A1 | 2/2005 | Chia et al. | | |
| 2006/0173687 | A1 * | 8/2006 | Spindola | ..... | 704/265 |
| 2007/0011009 | A1 * | 1/2007 | Nurminen et al. | ..... | 704/260 |
| 2007/0112570 | A1 * | 5/2007 | Kaneyasu | ..... | 704/260 |
| 2008/0027715 | A1 * | 1/2008 | Rajendran et al. | ..... | 704/205 |

FOREIGN PATENT DOCUMENTS

JP 2003-218932 7/2003

* cited by examiner

*Primary Examiner* — Michael Colucci
(74) *Attorney, Agent, or Firm* — Finnegan, Henderson, Farabow, Garrett & Dunner, L.L.P.

(57) ABSTRACT

A signal processing apparatus includes a decoding unit, an analyzing unit, a synthesizing unit, and a selecting unit. The decoding unit decodes an input encoded audio signal and outputs a playback audio signal. When loss of the encoded audio signal occurs, the analyzing unit analyzes the playback audio signal output before the loss occurs and generates a linear predictive residual signal. The synthesizing unit synthesizes a synthesized audio signal on the basis of the linear predictive residual signal. The selecting unit selects one of the synthesized audio signal and the playback audio signal and outputs the selected audio signal as a continuous output audio signal.

17 Claims, 31 Drawing Sheets

FIG. 30

| FRAME NUMBER | 0 | 1 | 2 | 3 | 4 | 5 | 6 | 7 | 8 | 9 | 10 | 11 |
|---|---|---|---|---|---|---|---|---|---|---|---|---|
| SECOND ERROR FLAG Fe2 | 0 | 0 | 1 | 0 | 0 | 1 | 1 | 0 | 1 | 0 | 0 | 0 |
| ERROR STATUS | 0 | 0 | 1 | −2 | −1 | 1 | 2 | −2 | 2 | −2 | −1 | 0 |
| SIGNAL DECODING UNIT 35 | ○ | ○ | × | △ | ○ | × | × | △ | × | △ | ○ | ○ |
| SIGNAL ANALYZING UNIT 37 | × | × | ○ | × | × | ○ | × | × | × | × | × | × |
| SIGNAL SYNTHESIZING UNIT 38 | × | × | ○ | ○ | ○ | ○ | ○ | ○ | ○ | ○ | ○ | × |

APPARATUS AND METHOD FOR PROCESSING SIGNAL, RECORDING MEDIUM, AND PROGRAM

CROSS REFERENCES TO RELATED APPLICATIONS

The present invention contains subject matter related to Japanese Patent Application JP 2006-236222 filed in the Japanese Patent Office on Aug. 31, 2006, the entire contents of which are incorporated herein by reference.

BACKGROUND OF THE INVENTION

1. Field of the Invention

The present invention relates to an apparatus and a method for processing signals, a recording medium, and a program and, in particular, to an apparatus and a method for processing signals, a recording medium, and a program capable of outputting a natural sounding voice even when a packet to be received is lost.

2. Description of the Related Art

Recently, IP (Internet protocol) telephones have attracted attention. IP telephones employ VoIP (voice over Internet protocol) technology. In this technology, an IP network, such as the Internet, is employed as part of or the entirety of a telephone network. Voice data is compressed using a variety of encoding methods and is converted into data packets. The data packets are transmitted over the IP network in real time.

In general, there are two types of voice data encoding methods: parametric encoding and waveform encoding. In parametric encoding, a frequency characteristic and a pitch period (i.e., a basic cycle) are retrieved from original voice data as parameters. Even when some data is destroyed or lost in the transmission path, a decoder can easily reduce the affect caused by the loss of the data by using the previous parameters directly or after some process is performed on the previous parameters. Accordingly, parametric encoding has been widely used. However, although parametric encoding provides a high compression ratio, parametric encoding disadvantageously exhibits poor reproducibility of the waveform in processed sound.

In contrast, in waveform encoding, voice data is basically encoded on the basis of the image of a waveform. Although the compression ratio is not so high, waveform encoding can provide high-fidelity processed sound. In addition, in recent years, some waveform encoding methods have provided a relatively high compression ratio. Furthermore, high-speed communication networks have been widely used. Therefore, the use of waveform encoding has already been started in the field of communications.

Even in waveform encoding, a technique performed on the reception side has been proposed that reduces the affect caused by the loss of data if the data is destroyed or lost in a transmission path (refer to, for example, Japanese Unexamined Patent Application Publication No. 2003-218932).

SUMMARY OF THE INVENTION

However, in the technique described in Japanese Unexamined Patent Application Publication No. 2003-218932, unnatural sound like a buzzer sound is output, and it is difficult to output sound that is natural for human ears.

Accordingly, the present invention provides an apparatus and a method for processing signal, a recording medium, and a program capable of outputting natural sound even when a packet to be received is lost.

According to an embodiment of the present invention, a signal processing apparatus includes decoding means for decoding an input encoded audio signal and outputting a playback audio signal, analyzing means for, when loss of the encoded audio signal occurs, analyzing the playback audio signal output before the loss occurs and generating a linear predictive residual signal, synthesizing means for synthesizing a synthesized audio signal on the basis of the linear predictive residual signal, and selecting means for selecting one of the synthesized audio signal and the playback audio signal and outputting the selected audio signal as a continuous output audio signal.

The analyzing means can include linear predictive residual signal generating means for generating the linear predictive residual signal serving as a feature parameter and parameter generating means for generating, from the linear predictive residual signal, a first feature parameter serving as a different feature parameter. The synthesizing means can generate the synthesized audio signal on the basis of the first feature parameter.

The linear predictive residual signal generating means can further generate a second feature parameter, and the synthesizing means can generate the synthesized audio signal on the basis of the first feature parameter and the second feature parameter.

The linear predictive residual signal generating means can compute a linear predictive coefficient serving as the second feature parameter. The parameter generating means can include filtering means for filtering the linear predictive residual signal and pitch extracting means for generating a pitch period and pitch gain as the first feature parameter. The pitch period can be determined to be an amount of delay of the filtered linear predictive residual signal when the autocorrelation of the filtered linear predictive residual signal is maximized, and the pitch gain can be determined to be the autocorrelation.

The synthesizing means can include synthesized linear predictive residual signal generating means for generating a synthesized linear predictive residual signal from the linear predictive residual signal and synthesized signal generating means for generating a linear predictive synthesized signal to be output as the synthesized audio signal by filtering the synthesized linear predictive residual signal in accordance with a filter property defined by the second feature parameter.

The synthesized linear predictive residual signal generating means can include noise-like residual signal generating means for generating a noise-like residual signal having a randomly varying phase from the linear predictive residual signal, periodic residual signal generating means for generating a periodic residual signal by repeating the linear predictive residual signal in accordance with the pitch period, and synthesized residual signal generating means for generating a synthesized residual signal by summing the noise-like residual signal and the periodic residual signal in a predetermined proportion on the basis of the first feature parameter and outputting the synthesized residual signal as the synthesized linear predictive residual signal.

The noise-like residual signal generating means can include Fourier transforming means for performing a fast Fourier transform on the linear predictive residual signal so as to generate a Fourier spectrum signal, smoothing means for smoothing the Fourier spectrum signal, noise-like spectrum generating means for generating a noise-like spectrum signal by adding different phase components to the smoothed Fourier spectrum signal, and inverse fast Fourier transforming means for performing an inverse fast Fourier transform on the noise-like spectrum signal so as to generate the noise-like residual signal.

The synthesized residual signal generating means can include first multiplying means for multiplying the noise-like residual signal by a first coefficient determined by the pitch gain, second multiplying means for multiplying the periodic residual signal by a second coefficient determined by the pitch gain, and adding means for summing the noise-like residual signal multiplied by the first coefficient and the periodic residual signal multiplied by the second coefficient to obtain a synthesized residual signal and outputting the obtained synthesized residual signal as the synthesized linear predictive residual signal.

When the pitch gain is smaller than a reference value, the periodic residual signal generating means can generate the periodic residual signal by reading out the linear predictive residual signal at random positions thereof instead of repeating the linear predictive residual signal in accordance with the pitch period.

The synthesizing means can further include a gain-adjusted synthesized signal generating means for generating a gain-adjusted synthesized signal by multiplying the linear predictive synthesized signal by a coefficient that varies in accordance with an error status value or an elapsed time of an error state of the encoded audio signal.

The synthesizing means can further include a synthesized playback audio signal generating means for generating a synthesized playback audio signal by summing the playback audio signal and the gain-adjusted synthesized signal in a predetermined proportion and outputting means for selecting one of the synthesized playback audio signal and the gain-adjusted synthesized signal and outputting the selected one as the synthesized audio signal.

The signal processing apparatus can further include decomposing means for supplying the encoded audio signal obtained by decomposing the received packet to the decoding means.

The synthesizing means can include controlling means for controlling the operations of the decoding means, the analyzing means, and the synthesizing means itself depending on the presence or absence of an error in the audio signal.

In the case where an error affects the processing of another audio signal, the controlling means can perform control so that the synthesized audio signal is output in place of the playback audio signal even when an error is not present.

According to another embodiment of the present invention, a method, a computer-readable program, or a recording medium containing the computer-readable program for processing a signal includes the steps of decoding an input encoded audio signal and outputting a playback audio signal, analyzing, when loss of the encoded audio signal occurs, the playback audio signal output before the loss occurs and generating a linear predictive residual signal, synthesizing a synthesized audio signal on the basis of the linear predictive residual signal, and selecting one of the synthesized audio signal and the playback audio signal and outputting the selected audio signal as a continuous output audio signal.

According to the embodiments of the present invention, a playback audio signal obtained by decoding an encoded audio signal is analyzed so that a linear predictive residual signal is generated. A synthesized audio signal is generated on the basis of the generated linear predictive residual signal. Thereafter, one of the synthesized audio signal and the playback audio signal is selected and is output as a continuous output audio signal.

As noted above, according to the embodiments of the present invention, even when a packet is lost, the number of discontinuities of a playback audio signal can be reduced. In particular, according to the embodiments of the present invention, an audio signal that produces a more natural sounding voice can be output.

BRIEF DESCRIPTION OF THE DRAWINGS

FIG. 30 is a diagram illustrating a change in an error state of a frame.

DESCRIPTION OF THE PREFERRED EMBODIMENTS

Figure 1:
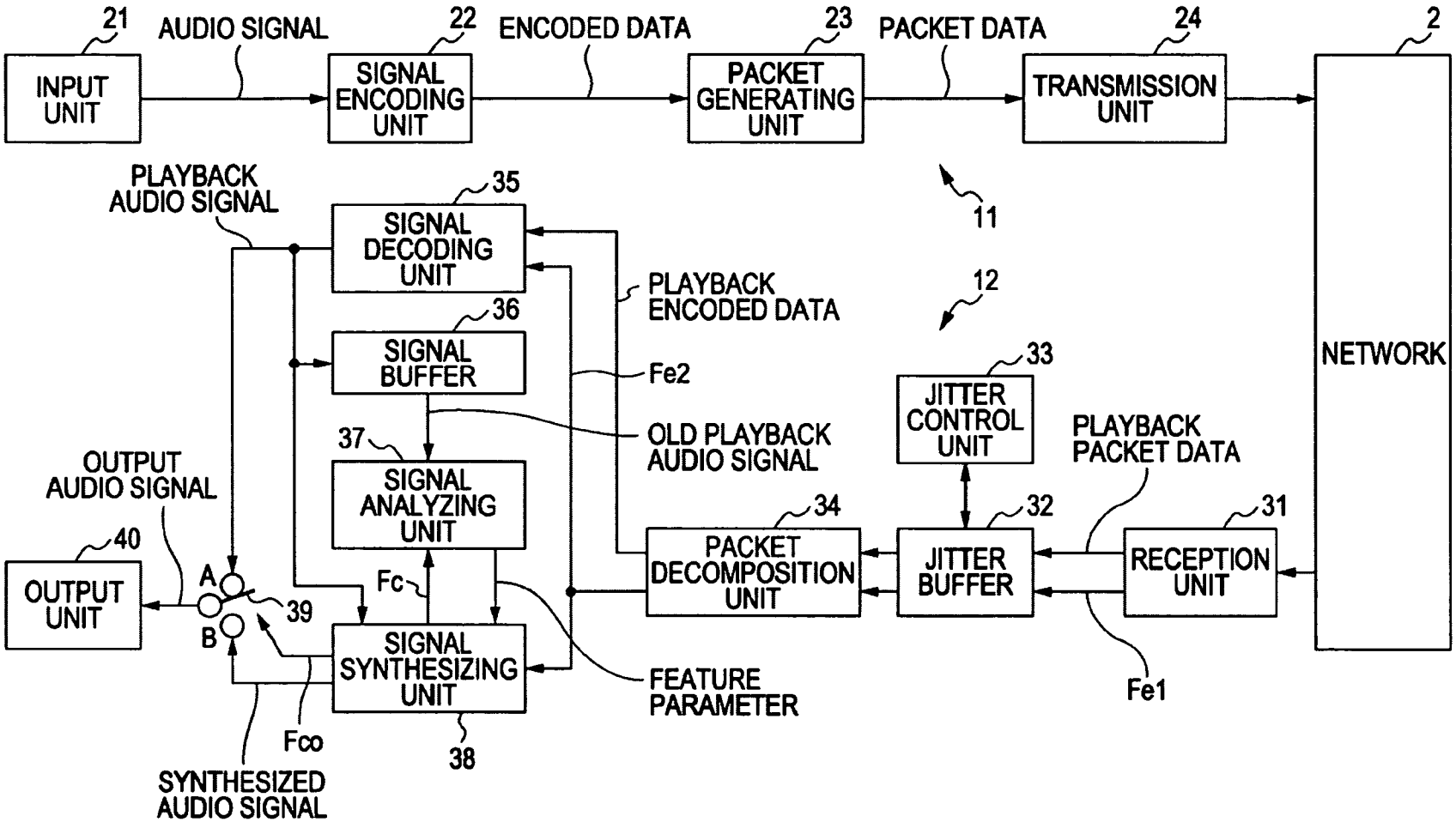
FIG. 1 is a block diagram of a packet voice communication apparatus according to an exemplary embodiment of the present invention.

Before describing an embodiment of the present invention, the correspondence between the features of the claims and the specific elements disclosed in an embodiment of the present invention is discussed below. This description is intended to assure that an embodiment supporting the claimed invention is described in this specification. Thus, even if an element in the following embodiment is not described as relating to a certain feature of the present invention, that does not necessarily mean that the element does not relate to that feature of the claims. Conversely, even if an element is described herein as relating to a certain feature of the claims, that does not necessarily mean that the element does not relate to other features of the claims.

Furthermore, this description should not be construed as restricting that all the aspects of the invention disclosed in the embodiment are described in the claims. That is, the description does not deny the existence of aspects of the present invention that are described in the embodiment but not claimed in the invention of this application, i.e., the existence of aspects of the present invention that in future may be claimed by a divisional application, or that may be additionally claimed through amendments.

According to an embodiment of the present invention, a signal processing apparatus (e.g., a packet voice communication apparatus 1 shown in FIG. 1) includes decoding means (e.g., a signal decoding unit 35 shown in FIG. 1) for decoding an input encoded audio signal and outputting a playback audio signal, analyzing means (e.g., a signal analyzing unit 37 shown in FIG. 1) for, when loss of the encoded audio signal occurs, analyzing the playback audio signal output before the loss occurs and generating a linear predictive residual signal, synthesizing means (e.g., a signal synthesizing unit 38 shown in FIG. 1) for synthesizing a synthesized audio signal (e.g., a synthesized audio signal shown in FIG. 1) on the basis of the linear predictive residual signal, and selecting means (e.g., a switch 39 shown in FIG. 1) for selecting one of the synthesized audio signal and the playback audio signal and outputting the selected audio signal as a continuous output audio signal.

Figure 2:
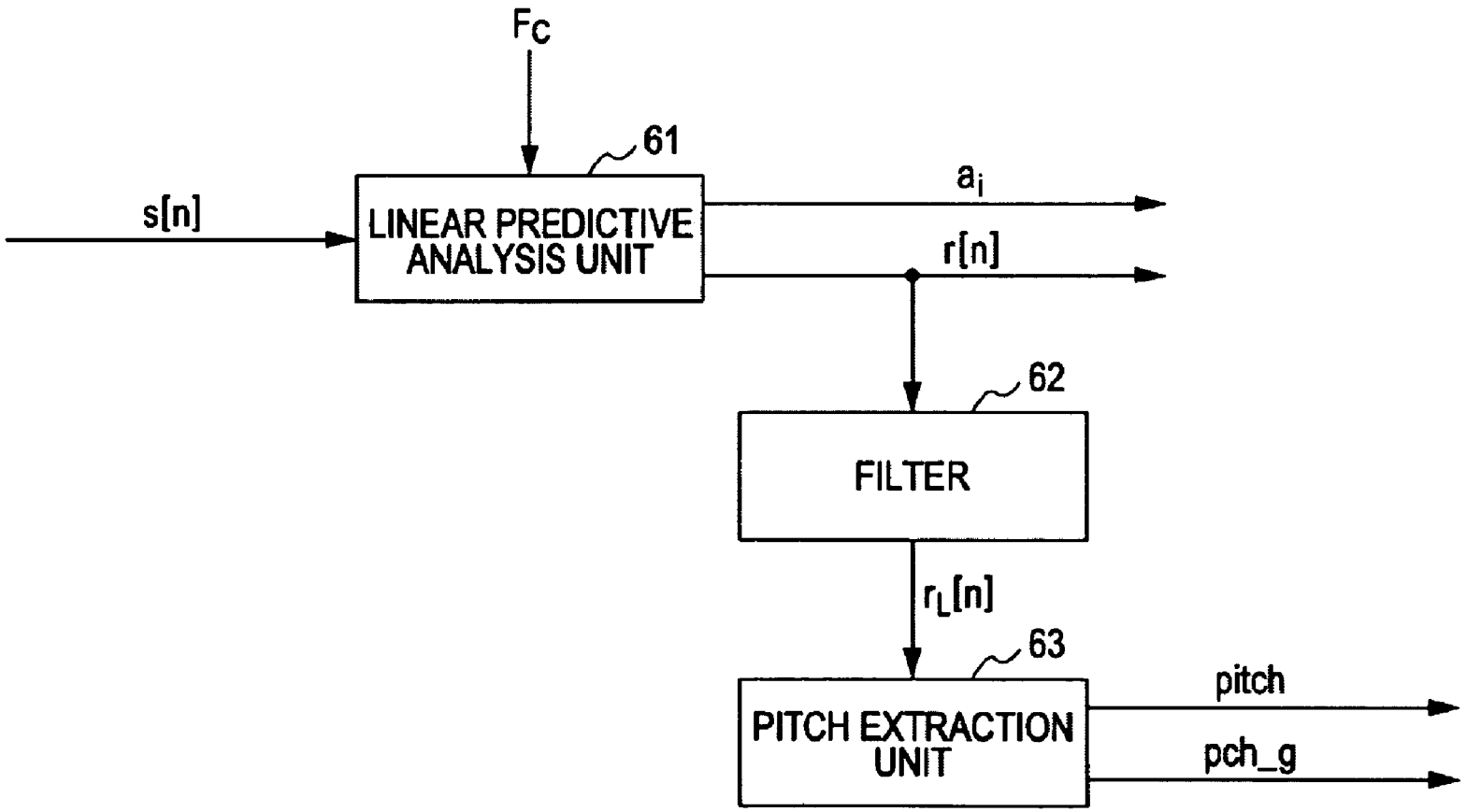
FIG. 2 is a block diagram illustrating an example configuration of a signal analyzing unit.

The analyzing means can include linear predictive residual signal generating means (e.g., a linear predictive analysis unit 61 shown in FIG. 2) for generating the linear predictive residual signal serving as a feature parameter and parameter generating means (e.g., a filter 62 and a pitch extraction unit 63 shown in FIG. 2) for generating, from the linear predictive residual signal, a first feature parameter serving as a different feature parameter (e.g., a pitch period "pitch" and a pitch gain pch_g shown in FIG. 2). The synthesizing means can generate the synthesized audio signal on the basis of the first feature parameter.

The linear predictive residual signal generating means can further generate a second feature parameter (e.g., a linear predictive coefficient shown in FIG. 2), and the synthesizing means can generate the synthesized audio signal on the basis of the first feature parameter and the second feature parameter.

The linear predictive residual signal generating means can compute a linear predictive coefficient serving as the second feature parameter. The parameter generating means can include filtering means (e.g., the filter 62 shown in FIG. 2) for filtering the linear predictive residual signal and pitch extracting means (e.g., the pitch extraction unit 63 shown in FIG. 2) for generating a pitch period and pitch gain as the first feature parameter. The pitch period can be determined to be an amount of delay of the filtered linear predictive residual signal when the autocorrelation of the filtered linear predictive residual signal is maximized, and the pitch gain can be determined to be the autocorrelation.

The synthesizing means can include synthesized linear predictive residual signal generating means (e.g., a block 121 shown in FIG. 3) for generating a synthesized linear predictive residual signal (e.g., a synthesized residual signal $r_A[n]$ shown in FIG. 3) from the linear predictive residual signal and synthesized signal generating means (e.g., an LPC synthesis unit 110 shown in FIG. 3) for generating a linear predictive synthesized signal to be output as the synthesized audio signal (e.g., a synthesized audio signal $S_H''([n]$ shown in FIG. 3) by filtering the synthesized linear predictive residual signal in accordance with a filter property defined by the second feature parameter.

The synthesized linear predictive residual signal generating means can include noise-like residual signal generating means (e.g., a block 122 shown in FIG. 3) for generating a noise-like residual signal having a randomly varying phase from the linear predictive residual signal, periodic residual signal generating means (e.g., a signal repeating unit 107 shown in FIG. 3) for generating a periodic residual signal by repeating the linear predictive residual signal in accordance with the pitch period, and synthesized residual signal generating means (e.g., a block 123 shown in FIG. 3) for generating a synthesized residual signal by summing the noise-like residual signal and the periodic residual signal in a predetermined proportion on the basis of the first feature parameter and outputting the synthesized residual signal as the synthesized linear predictive residual signal.

The noise-like residual signal generating means can include Fourier transforming means (e.g., an FFT unit 102 shown in FIG. 3) for performing a fast Fourier transform on the linear predictive residual signal so as to generate a Fourier spectrum signal, smoothing means (e.g., a spectrum smoothing unit 103 shown in FIG. 3) for smoothing the Fourier spectrum signal, noise-like spectrum generating means (e.g., a noise-like spectrum generation unit 104 shown in FIG. 3) for generating a noise-like spectrum signal by adding different phase components to the smoothed Fourier spectrum signal, and inverse fast Fourier transforming means (e.g., an IFFT unit 105 shown in FIG. 3) for performing an inverse fast Fourier transform on the noise-like spectrum signal so as to generate the noise-like residual signal.

The synthesized residual signal generating means can include first multiplying means (e.g., a multiplier 106 shown in FIG. 3) for multiplying the noise-like residual signal by a first coefficient (e.g., a coefficient $\beta_2$ shown in FIG. 3) determined by the pitch gain, second multiplying means (e.g., a multiplier 108 shown in FIG. 3) for multiplying the periodic residual signal by a second coefficient (e.g., a coefficient $\beta_1$ shown in FIG. 3) determined by the pitch gain, and adding means (e.g., an adder 109 shown in FIG. 3) for summing the noise-like residual signal multiplied by the first coefficient and the periodic residual signal multiplied by the second coefficient to obtain a synthesized residual signal and outputting the obtained synthesized residual signal as the synthesized linear predictive residual signal.

When the pitch gain is smaller than a reference value, the periodic residual signal generating means can generate the periodic residual signal by reading out the linear predictive residual signal at random positions thereof instead of repeating the linear predictive residual signal in accordance with the pitch period (e.g., an operation according to equations (6) and (7)).

The synthesizing means can further include a gain-adjusted synthesized signal generating means (e.g., a multiplier 111 shown in FIG. 3) for generating a gain-adjusted synthesized signal by multiplying the linear predictive synthesized signal by a coefficient (e.g., a coefficient $\beta_3$ shown in FIG. 3) that varies in accordance with an error status value or an elapsed time of an error state of the encoded audio signal.

The synthesizing means can further include a synthesized playback audio signal generating means (e.g., an adder 114 shown in FIG. 3) for generating a synthesized playback audio signal by summing the playback audio signal and the gain-adjusted synthesized signal in a predetermined proportion and outputting means (e.g., a switch 115 shown in FIG. 3) for selecting one of the synthesized playback audio signal and the gain-adjusted synthesized signal and outputting the selected one as the synthesized audio signal.

The signal processing apparatus can further include decomposing means (e.g., a packet decomposition unit 34 shown in FIG. 1) for supplying the encoded audio signal obtained by decomposing the received packet to the decoding means.

The synthesizing means can include controlling means (e.g., a state control unit 101 shown in FIG. 3) for controlling the operations of the decoding means, the analyzing means, and the synthesizing means itself depending on the presence or absence of an error in the audio signal.

In the case where an error affects the processing of another audio signal, the controlling means can perform control so that the synthesized audio signal is output in place of the playback audio signal even when an error is not present (e.g., a process performed when the error status is "−2" as shown in FIG. 30).

Figure 6:
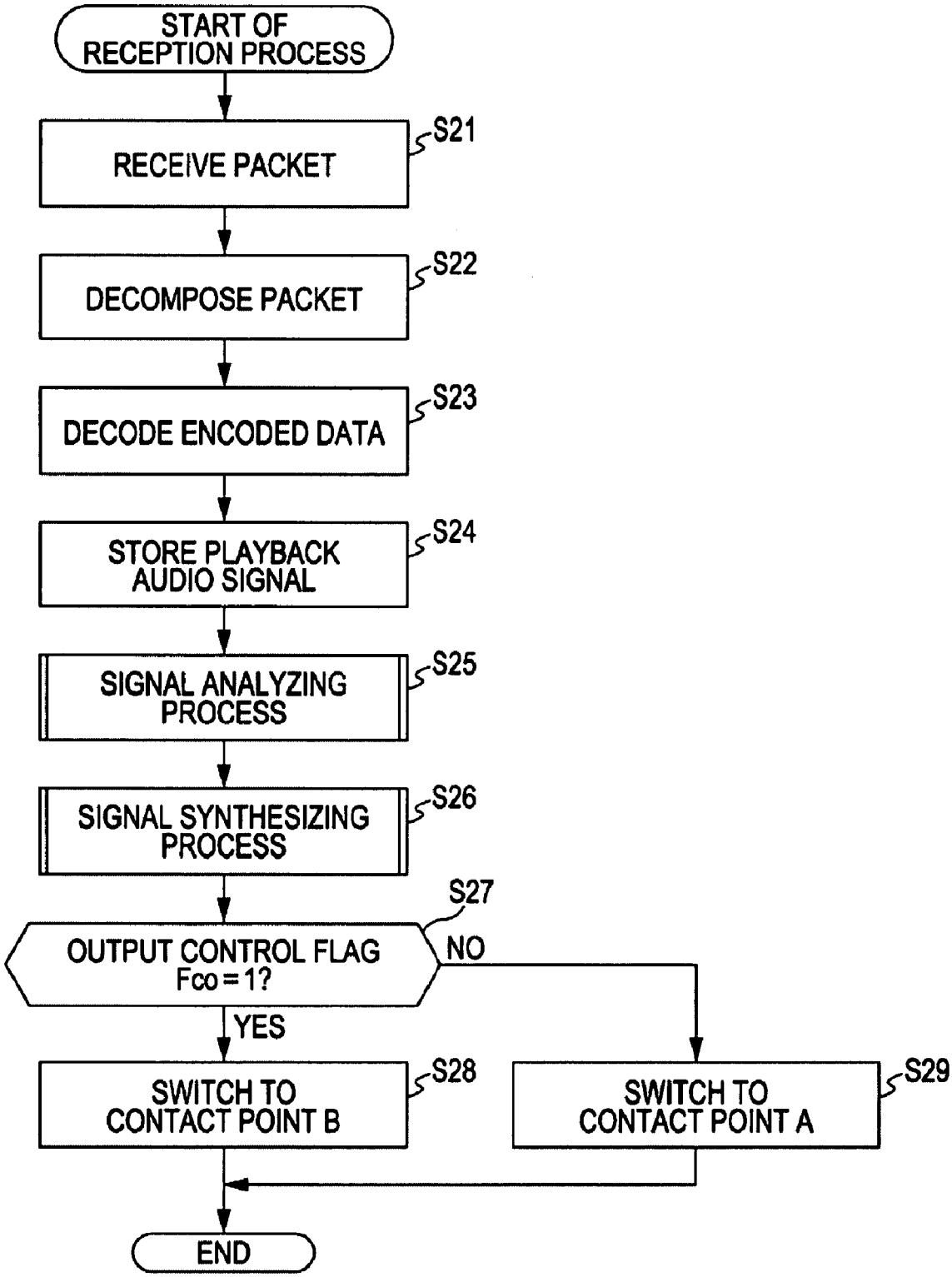
FIG. 6 is a flow chart illustrating a reception process.

According to another embodiment of the present invention, a method for processing a signal (e.g., a method employed in a reception process shown in FIG. 6), a computer-readable program for processing a signal, or a recording medium containing the computer-readable program includes the steps of decoding an input encoded audio signal and outputting a playback audio signal (e.g., step S23 of FIG. 6), analyzing, when loss of the encoded audio signal occurs, the playback audio signal output before the loss occurs and generating a linear predictive residual signal (e.g., step S25 of FIG. 6), synthesizing a synthesized audio signal on the basis of the linear predictive residual signal (e.g., step S26 of FIG. 6), and selecting one of the synthesized audio signal and the playback audio signal and outputting the selected audio signal as a continuous output audio signal (e.g., steps S28 and S29 of FIG. 6).

Exemplary embodiments of the present invention are described below with reference to the accompanying drawings.

According to the exemplary embodiments of the present invention, a system is provided in which an audio signal, such as signals of a human voice, is encoded by a waveform encoder, the encoded audio signal is transmitted via a transmission path, and the encoded audio signal is decoded by a waveform decoder located on the reception side to be played back. In this system, if the transmitted information is destroyed or lost primarily in the transmission path and the waveform decoder located on the reception side detects the destruction or the loss of the information, the waveform decoder generates an alternative signal using information obtained by extracting the features from the previously reproduced signals. Thus, the affect caused by the loss of information is reduced.

FIG. 1 is a block diagram of a packet voice communication apparatus 1 according to an embodiment of the present invention. According to the present embodiment, encoded data for one frame is used for decoding two successive frames.

The packet voice communication apparatus 1 includes a transmission block 11 and a reception block 12. The transmission block 11 includes an input unit 21, a signal encoding unit 22, a packet generating unit 23, and a transmission unit 24. The reception block 12 includes a reception unit 31, a jitter buffer 32, a jitter control unit 33, a packet decomposition unit 34, a signal decoding unit 35, a signal buffer 36, a signal analyzing unit 37, a signal synthesizing unit 38, a switch 39, and an output unit 40.

The input unit 21 of the transmission block 11 incorporates a microphone, which primarily picks up a human voice. The input unit 21 outputs an audio signal corresponding to the human voice input to the input unit 21. The audio signal is separated into frames, which represent predetermined time intervals.

The signal encoding unit 22 converts the audio signal into encoded data using, for example, an adaptive transform acoustic coding (ATRAC) (trademark) method. In the ATRAC method, an audio signal is separated into four frequency ranges first. Subsequently, the time-based data of the audio signal are converted to frequency-based data using modified discrete cosine transform (modified DCT). Thus, the audio signal is encoded and compressed.

The packet generating unit 23 concatenates some of or all of one or more encoded data items input from the signal encoding unit 22. Thereafter, the packet generating unit 23 adds a header to the concatenated data items so as to generate packet data. The transmission unit 24 processes the packet data supplied from the packet generating unit 23 so as to generate transmission data for VoIP and transmits the transmission data to a packet voice communication apparatus (not shown) at the other end via a network 2, such as the Internet.

As used herein, the term "network" refers to an interconnected system of at least two apparatuses, where one apparatus can transmit information to a different apparatus. The apparatuses that communicate with each other via the network may be independent from each other or may be internal apparatuses of a system.

Additionally, the term "communication" includes wireless communication, wired communication, and a combination thereof in which wireless communication is performed in some zones and wired communication is performed in the other zones. Furthermore, a first apparatus may communicate with a second apparatus using wired communication, and the second apparatus may communicate with a third apparatus using wireless communication.

The reception unit 31 of the reception block 12 receives data transmitted from the packet voice communication apparatus at the other end via the network 2. Subsequently, the reception unit 31 converts the data into a playback packet data and outputs the playback packet data. If the reception unit 31 detects the absence of a packet to be received for some reason or some error in the received data, the reception unit 31 sets a first error flag Fe1 to "1". Otherwise, the reception unit 31 sets an error flag to "0". Thereafter, the reception unit 31 outputs the flag.

The jitter buffer 32 is a memory for temporarily storing the playback packet data supplied from the reception unit 31 and the first error flag Fe1. The jitter control unit 33 performs control so as to deliver the playback packet data and the first error flag Fe1 to the packet decomposition unit 34 connected downstream of the jitter control unit 33 at relatively constant intervals even when the reception unit 31 cannot receive packet data at constant intervals.

The packet decomposition unit 34 receives the playback packet data and the first error flag Fe1 from the jitter buffer 32. If the first error flag Fe1 is set to "0", the packet decomposition unit 34 considers the playback packet data to be normal data and processes the playback packet data. However, if the first error flag Fe1 is set to "1", the packet decomposition unit 34 discards the playback packet data. In addition, the packet decomposition unit 34 decomposes the playback packet data to generate playback encoded data. Subsequently, the packet decomposition unit 34 outputs the playback encoded data to the signal decoding unit 35. At that time, if the playback encoded data is normal, the packet decomposition unit 34 sets a second error flag Fe2 to "0". However, if the playback encoded data has some error or the playback encoded data is not present, that is, if the playback encoded data is substantially lost, the packet decomposition unit 34 sets the second error flag Fe2 to "1". Subsequently, the packet decomposition unit 34 outputs the second error flag Fe2 to the signal decoding unit 35 and the signal synthesizing unit 38.

If the second error flag Fe2 supplied from the packet decomposition unit 34 is set to "0", the signal decoding unit 35 decodes the playback encoded data also supplied from the packet decomposition unit 34 using a decoding method corresponding to the encoding method used in the signal encoding unit 22. Thus, the signal decoding unit 35 outputs a playback audio signal. In contrast, if the second error flag Fe2 is set to "1", the signal decoding unit 35 does not decode the playback encoded data.

The signal buffer 36 temporarily stores the playback audio signal output from the signal buffer 36. Thereafter, the signal buffer 36 outputs the stored playback audio signal to the signal analyzing unit 37 as an old playback audio signal at a predetermined timing.

If a control flag Fc supplied from the signal synthesizing unit 38 is set to "1", the signal analyzing unit 37 analyzes the old playback audio signal supplied from the signal buffer 36. Subsequently, the signal analyzing unit 37 outputs, to the signal synthesizing unit 38, feature parameters, such as a linear predictive coefficient $a_i$ serving as a short-term predictive coefficient, a linear predictive residual signal r[n] serving as a short-term predictive residual signal, a pitch period "pitch", and pitch gain pch_g.

When the value of the second error flag Fe2 changes from "0" to "1" (in the case of the second, fifth, and eighth frames shown in FIG. 30, described below), the signal synthesizing unit 38 sets the control flag Fc to "1" and outputs the control flag Fc to the signal analyzing unit 37. Thereafter, the signal synthesizing unit 38 receives the feature parameters from the signal analyzing unit 37. In addition, the signal synthesizing unit 38 generates a synthesized audio signal on the basis of the feature parameters and outputs the synthesized audio signal. Furthermore, when the value of the second error flag Fe2 changes from "1" to "0" successively two times (e.g., in the case of the fourth and tenth frames shown in FIG. 30, described below), the signal synthesizing unit 38 sums the playback audio signal supplied from the signal decoding unit 35 and an internally generated gain-adjusted synthesized signal $S_A'[n]$ in a predetermined proportion. Thereafter, the signal synthesizing unit 38 outputs the sum as a synthesized audio signal.

The switch 39 selects one of the playback audio signal output from the signal decoding unit 35 and the synthesized audio signal output from the signal synthesizing unit 38 on the basis of an output control flag Fco supplied from the signal synthesizing unit 38. Thereafter, the switch 39 outputs the selected audio signal to the output unit 40 as a continuous output audio signal. The output unit 40 including, for example, a speaker outputs sound corresponding to the output audio signal.

FIG. 2 is a block diagram of the signal analyzing unit 37. The signal analyzing unit 37 includes a linear predictive analysis unit 61, a filter 62, and a pitch extraction unit 63.

Upon detecting that the control flag Fc received from the signal synthesizing unit 38 is set to "1", the linear predictive analysis unit 61 applies a pth-order linear prediction filter $A^{-1}(z)$ to an old playback audio signal s[n] including N samples supplied from the signal decoding unit 35. Thus, the linear predictive analysis unit 61 generates a linear predictive residual signal r[n] which is filtered by the linear prediction filter $A^{-1}(z)$, and derives the linear predictive coefficient $a_i$ of the linear prediction filter $A^{-1}(z)$. The linear prediction filter $A^{-1}(z)$ is expressed as follows:

$$A^{-1}(z) = 1 - \sum_{i=1}^{P} a_i z^{-i} \tag{1}$$

For example, the filter 62 composed of a lowpass filter filters the linear predictive residual signal r[n] generated by the linear predictive analysis unit 61 using an appropriate filter characteristic so as to compute a filtered linear predictive residual signal $r_L[n]$. In order to obtain the pitch period "pitch" and the pitch gain pch_g from the filtered linear predictive residual signal $r_L[n]$ generated by the filter 62, the pitch extraction unit 63 performs the following computation:

$$r_w[n]=h[n]\cdot r_L[n] \tag{2}$$

where n=0, 1, 2, . . . , N−1.

That is, as indicated by equation (2), the pitch extraction unit 63 multiplies the filtered linear predictive residual signal $r_L[n]$ by a predetermined window function h[n] so as to generate a windowed residual signal $r_w[n]$.

Subsequently, the pitch extraction unit 63 computes the autocorrelation ac[L] of the windowed residual signal $r_w[n]$ using the following equation:

$$\mathrm{ac}[L] = \frac{\sum_{n=max(0,2L-N)}^{L-1} r_w[N-L+n]\cdot r_w[N-2\cdot L+n]}{\sqrt{\sum_{n=max(0,2L-N)}^{L-1} r_w[N-L+n]^2}\sqrt{\sum_{n=max(0,2L-N)}^{L-1} r_w[N-2\cdot L+n]^2}} \tag{3}$$

where $L=L_{min}, L_{min}+1, \ldots, L_{max}$.

Here, $L_{min}$ and $L_{max}$ denote the minimum value and the maximum value of a pitch period to be searched for, respectively.

The pitch period "pitch" is determined to be a sample value L when the autocorrelation ac[L] becomes maximum. The pitch gain pch_g is determined to be the value of the autocorrelation ac[L] at that time. However, the algorithm for determining the pitch period and the pitch gain may be changed to a different algorithm as needed.

Figure 3:
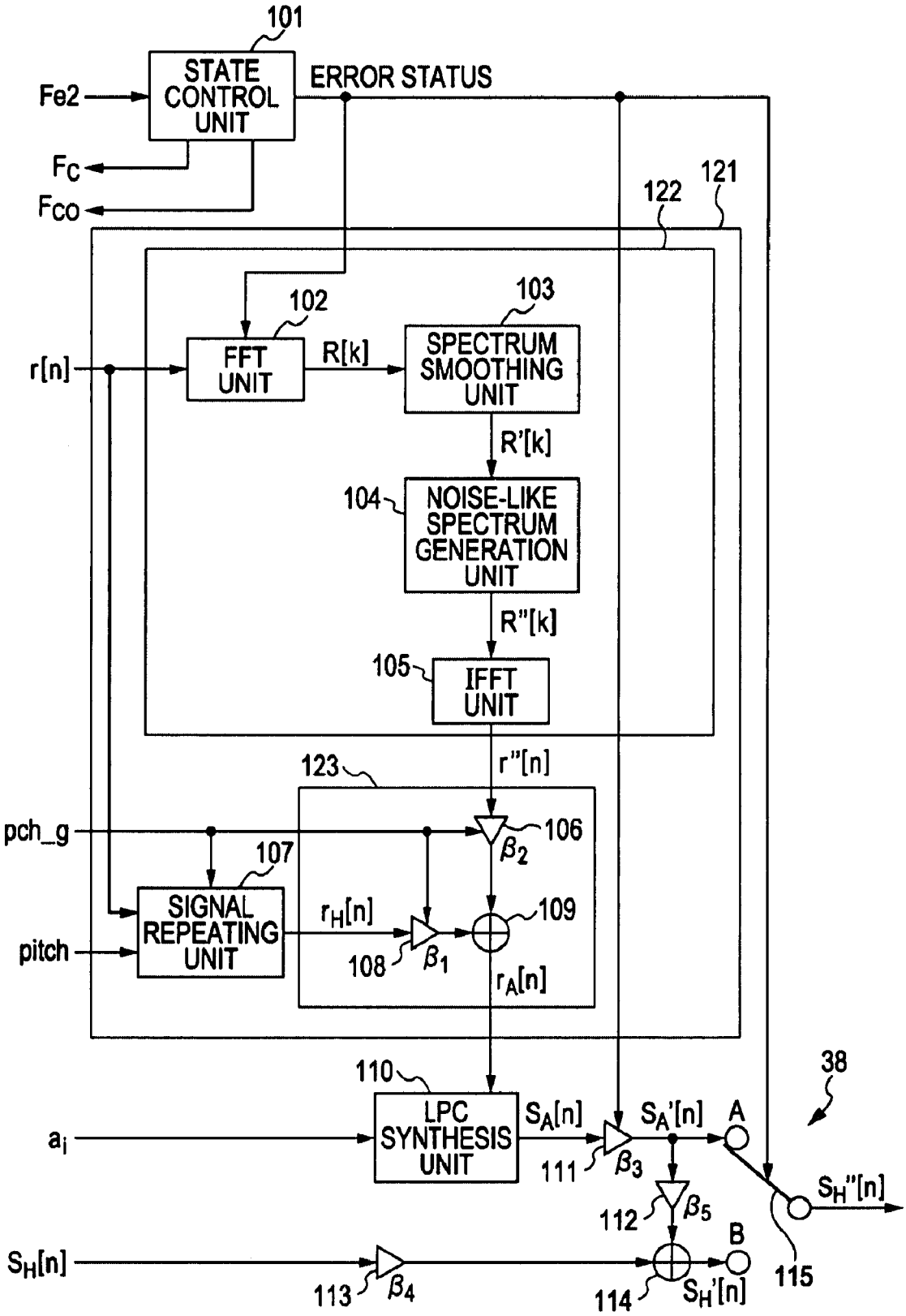
FIG. 3 is a block diagram illustrating an example configuration of a signal synthesizing unit.

FIG. 3 is a block diagram of the signal synthesizing unit 38. The signal synthesizing unit 38 includes a state control unit 101, a fast Fourier transform (FFT) unit 102, a spectrum smoothing unit 103, a noise-like spectrum generation unit 104, an inverse fast Fourier transform (IFFT) unit 105, a multiplier 106, a signal repeating unit 107, a multiplier 108, an adder 109, a linear predictive coding (LPC) synthesis unit 110, multipliers 111, 112, and 113, an adder 114, and a switch 115.

The state control unit 101 is formed from a state machine. The state control unit 101 generates the output control flag Fco on the basis of the second error flag Fe2 supplied from the packet decomposition unit 34 so as to control the switch 39. When the output control flag Fco is "0", the switch 39 is switched to a contact point A. While, when the output control flag Fco is "1", the switch 39 is switched to a contact point B. In addition, the state control unit 101 controls the FFT unit 102, the multiplier 111, and the switch 115 on the basis of the error status of the audio signal.

If the value of the error status is "1", the FFT unit 102 performs a fast Fourier transform. A coefficient $\beta_3$ that is to be multiplied, in the multiplier 111, by a linear predictive synthesized signal $S_A[n]$ output from the LPC synthesis unit 110 varies in accordance with the value of the error status and the elapsed time under the error status. When the value of the error status is "−1", the switch 115 is switched to the contact point B. Otherwise (i.e., when the value of the error status is −2, 0, 1, or 2), the switch 115 is switched to the contact point A.

The FFT unit 102 performs a fast Fourier transform process on the linear predictive residual signal r[n], that is, a feature parameter output from the linear predictive analysis unit 61 so as to obtain a Fourier spectrum signal R[k]. Subsequently, the FFT unit 102 outputs the obtained Fourier spectrum signal R[k] to the spectrum smoothing unit 103. The spectrum smoothing unit 103 smoothes the Fourier spectrum signal R[k] so as to obtain a smooth Fourier spectrum signal R'[k]. Subsequently, the spectrum smoothing unit 103 outputs the obtained Fourier spectrum signal R'[k] to the noise-like spectrum generation unit 104. The noise-like spectrum generation unit 104 randomly changes the phase of the smooth Fourier spectrum signal R'[k] so as to generate a noise-like spectrum signal R"[k]. Subsequently, the noise spectrum generation unit 104 outputs the noise-like spectrum signal R"[k] to the IFFT unit 105.

The IFFT unit 105 performs an inverse fast Fourier transform process on the input noise-like spectrum signal R"[k] so as to generate a noise-like residual signal r"[n]. Subsequently, the IFFT unit 105 outputs the generated noise-like residual signal r"[n] to the multiplier 106. The multiplier 106 multiplies the noise-like residual signal r"[n] by a coefficient $\beta_2$ and outputs the resultant value to the adder 109. Here, the coefficient $\beta_2$ is a function of the pitch gain pch_g, that is, a feature parameter supplied from the pitch extraction unit 63.

The signal repeating unit 107 repeats the linear predictive residual signal r[n] supplied from the linear predictive analysis unit 61 on the basis of the pitch period, that is, a feature parameter supplied from the pitch extraction unit 63 so as to generate a periodic residual signal $r_H[n]$. Subsequently, the signal repeating unit 107 outputs the generated periodic residual signal $r_H[n]$ to the multiplier 108. A function used for the repeat process performed by the signal repeating unit 107 is changed depending on the feature parameter (i.e., the pitch gain pch_g). The multiplier 108 multiplies the periodic residual signal $r_H[n]$ by a coefficient $\beta_1$ and outputs the resultant value to the adder 109. Like the coefficient $\beta_2$, the coefficient $\beta_1$ is a function of the pitch gain pch_g. The adder 109 sums the noise-like residual signal r"[n] input from the multiplier 106 and the periodic residual signal $r_H[n]$ input from the multiplier 108 so as to generate a synthesized residual signal $r_A[n]$. Thereafter, the adder 109 outputs the generated synthesized residual signal $r_A[n]$ to the LPC synthesis unit 110.

A block 121 includes the FFT unit 102, the spectrum smoothing unit 103, the noise-like spectrum generation unit 104, the IFFT unit 105, the multiplier 106, the signal repeating unit 107, the multiplier 108, and the adder 109. The block 121 computes the synthesized residual signal $r_A[n]$ serving as a synthesized linear predictive residual signal from the linear predictive residual signal r[n]. In the block 121, a block 122 including the FFT unit 102, the spectrum smoothing unit 103, the noise-like spectrum generation unit 104, and the IFFT unit 105 generates the noise-like residual signal r"[n] from the linear predictive residual signal r[n]. A block 123 including the multipliers 106 and 108 and the adder 109 combines a periodic residual signal $r_H[n]$ generated by the signal repeating unit 107 with the noise-like residual signal r"[n] in a predetermined proportion so as to compute the synthesized residual signal $r_A[n]$ serving as a synthesized linear predictive residual signal. If only the periodic residual signal is used, so-called "buzzer sound" is generated. However, the above-described synthesized linear predictive residual signal can provide natural sound quality to the sound of a human voice by including a noise-like residual signal that can reduce the buzzer sound.

The LPC synthesis unit 110 applies a filter function defined by the linear predictive coefficient $a_i$ supplied from the linear predictive analysis unit 61 to the synthesized residual signal $r_A[n]$ supplied from the adder 109 so as to generate the linear predictive synthesized signal $S_A[n]$. Subsequently, the LPC synthesis unit 110 outputs the generated linear predictive synthesized signal $S_A[n]$ to the multiplier 111. The multiplier 111 multiplies the linear predictive synthesized signal $S_A[n]$ by the coefficient $\beta_3$ so as to generate the gain-adjusted synthesized signal $S_A'[n]$. The multiplier 111 then outputs the generated gain-adjusted synthesized signal $S_A'[n]$ to the contact point A of the switch 115 and the multiplier 112. When the switch 115 is switched to the contact point A, the generated gain-adjusted synthesized signal $S_A'[n]$ is supplied to the contact point B of the switch 39 as a synthesized audio signal $S_H''[n]$.

The multiplier 112 multiplies the gain-adjusted synthesized signal $S_A'[n]$ by a coefficient $\beta_5$ of a predetermined value and outputs the resultant value to the adder 114. The multiplier 113 multiplies a playback audio signal $S_H[n]$ supplied from the signal decoding unit 35 by a coefficient $\beta_4$ of a predetermined value and outputs the resultant value to the adder 114. The adder 114 sums the generated gain-adjusted synthesized signal $S_A'[n]$ input from the multiplier 112 and the playback audio signal $S_H[n]$ input from the multiplier 113 so as to generate a synthesized audio signal $S_H'[n]$. The adder 114 then supplies the generated synthesized audio signal $S_H'[n]$ to the contact point B of the switch 115. When the switch 115 is switched to the contact point B, the synthesized audio signal $S_H'[n]$ is supplied to the contact point B of the switch 39 as the synthesized audio signal $S_H''[n]$.

Figure 4:
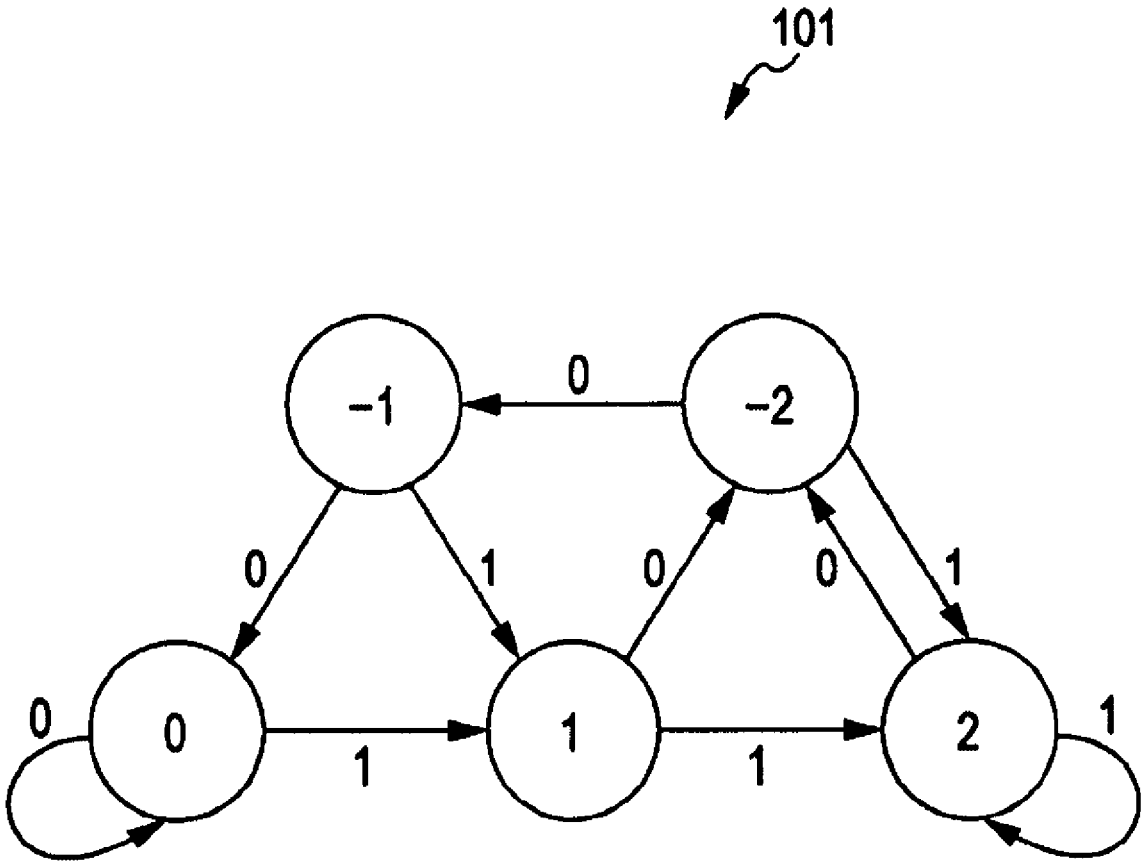
FIG. 4 is a state transition diagram of a state control unit.

FIG. 4 illustrates the structure of the state control unit 101. As shown in FIG. 4, the state control unit 101 is composed of a state machine. In FIG. 4, the number in each of the circles represents the error status, which controls each of the components of the signal synthesizing unit 38. The arrow extending from the circle represents the transition of the error status. The number next to the arrow represents the value of the second error flag Fe2.

For example, when the error status is "0" and the second error flag Fe2 is "0", the error status does not transit to another error status (e.g., step S95 in FIG. 12, described below). However, if the second error flag Fe2 is "1", the error status transits to the error status of "1" (e.g., step S86 in FIG. 12, described below).

When the error status is "1" and the second error flag Fe2 is "0", the error status transits to the error status of "−2" (e.g., step S92 in FIG. 12, described below). However, if the second error flag Fe2 is "1", the error status transits to the error status of "2" (e.g., step S89 in FIG. 12, described below).

When the error status is "2" and the second error flag Fe2 is "0", the error status transits to the error status of "−2" (e.g., step S92 in FIG. 12, described below). However, if the second error flag Fe2 is "1", the error status does not transit to another error status (e.g., step S89 in FIG. 12, described below).

When the error status is "−1" and the second error flag Fe2 is "0", the error status transits to the error status of "0" (e.g., step S95 in FIG. 12, described below). However, if the second error flag Fe2 is "1", the error status transits to the error status of "1" (e.g., step S86 in FIG. 12, described below).

When the error status is "−2" and the second error flag Fe2 is "0", the error status transits to the error status of "−1" (e.g., step S94 in FIG. 12, described below). However, if the second error flag Fe2 is "1", the error status transits to the error status of "2" (e.g., step S89 in FIG. 12, described below).

The operation of the packet voice communication apparatus 1 is described next.

Figure 5:
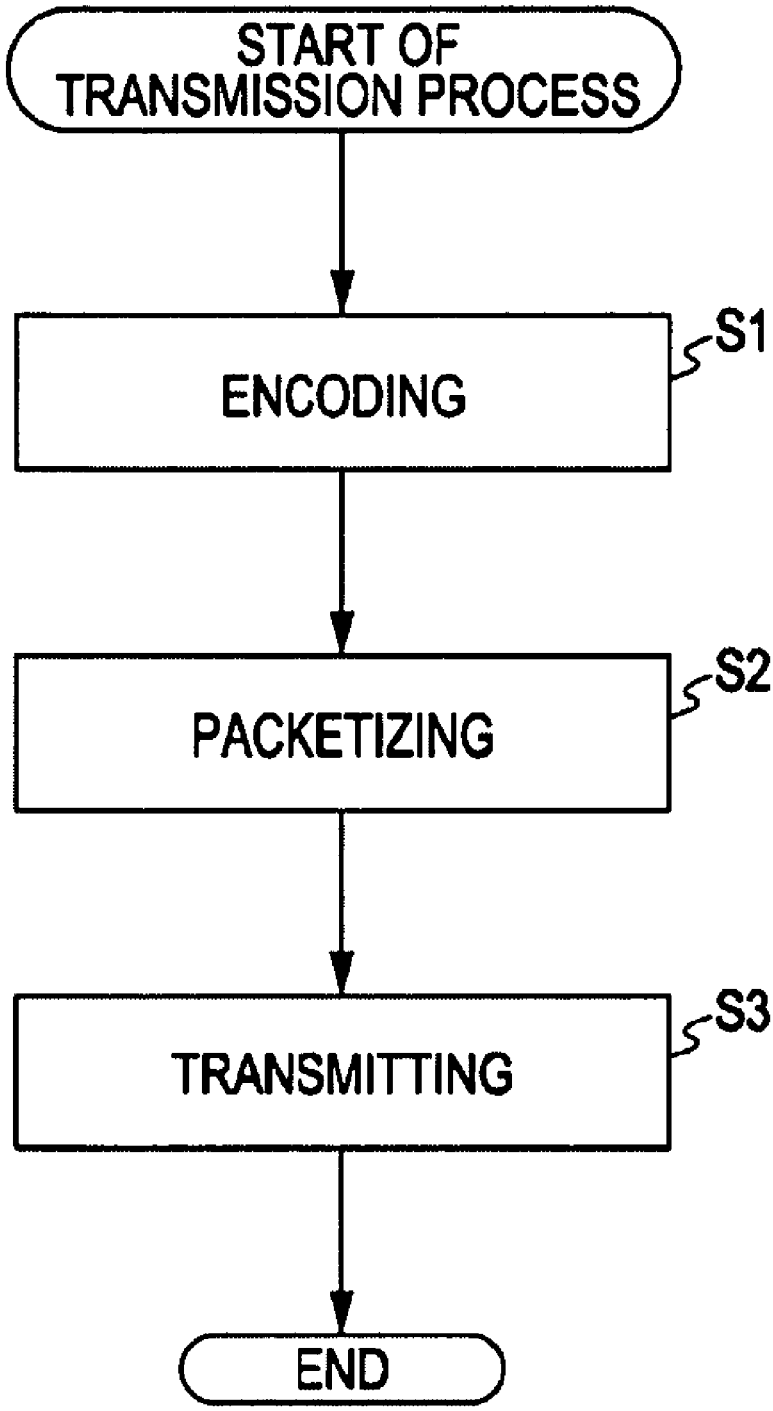
FIG. 5 is a flow chart illustrating a transmission process.

The transmission process is described first with reference to FIG. 5. In order to transmit voice to a packet voice communication apparatus at the other end, a user speaks into the input unit 21. The input unit 21 separates an audio signal corresponding to the voice of the user into frames of a digital signal. Subsequently, the input unit 21 supplies the audio signal to the signal encoding unit 22. At step S1, the signal encoding unit 22 encodes the audio signal input from the input unit 21 using the ATRAC method. However, a method other than the ATRAC method may be used.

At step S2, the packet generating unit 23 packetizes the encoded data output from the signal encoding unit 22. That is, the packet generating unit 23 concatenates some of or all of one or more encoded data items into a packet. Thereafter, the packet generating unit 23 adds a header to the packet. At step S3, the transmission unit 24 modulates the packet generated by the packet generating unit 23 so as to generate transmission data for VoIP and transmits the transmission data to a packet voice communication apparatus at the other end via the network 2.

The transmitted packet is received by the packet voice communication apparatus at the other end. When the packet voice communication apparatus 1 receives a packet transmitted by the packet voice communication apparatus at the other end via the network 2, the packet voice communication apparatus 1 performs a reception process shown in FIG. 6.

That is, in the system according to the present embodiment, the packet voice communication apparatus 1 at a transmission end separates the voice signal into signals for certain time intervals, encodes the signals, and transmits the signals via a transmission path. Upon receiving the signals, the packet voice communication apparatus at a reception end decodes the signals.

At step S21, the reception unit 31 receives the packet transmitted via the network 2. The reception unit 31 reconstructs packet data from the received data and outputs the reconstructed packet data. At that time, if the reception unit 31 detects an abnormal event, such as the absence of the packet data or an error in the packet data, the reception unit 31 sets the first error flag Fe1 to "1". However, if the reception unit 31 detects no abnormal events, the reception unit 31 sets the first error flag Fe1 to "0". Thereafter, the reception unit 31 outputs the first error flag Fe1. The output reconstructed packet data and first error flag Fe1 are temporarily stored in the jitter buffer 32. Subsequently, the output reconstructed packet data and first error flag Fe1 are supplied to the packet decomposition unit 34 at predetermined constant intervals. Thus, the possible delay over the network 2 can be compensated for.

At step S22, the packet decomposition unit 34 depacketizes the packet. That is, if the first error flag Fe1 is set to "0" (in the case of there being no abnormal events), the packet decomposition unit 34 depacketizes the packet and outputs the encoded data in the packet to the signal decoding unit 35 as playback encoded data. However, if the first error flag Fe1 is set to "1" (in the case of there being abnormal events), the packet decomposition unit 34 discards the packet data. In addition, if the playback encoded data is normal, the packet decomposition unit 34 sets the second error flag Fe2 to "0". However, if the packet decomposition unit 34 detects an abnormal event, such as an error in the playback encoded data or the loss of the encoded data, the packet decomposition unit 34 sets the second error flag Fe2 to "1". Thereafter, the packet decomposition unit 34 outputs the second error flag Fe2 to the signal decoding unit 35 and the signal synthesizing unit 38. Hereinafter, all of the abnormal events are also referred to as simply "data loss".

At step S23, the signal decoding unit 35 decodes the encoded data supplied from the packet decomposition unit 34. More specifically, if the second error flag Fe2 is set to "1" (in the case of there being abnormal events), the signal decoding unit 35 does not execute the decoding process. However, if the second error flag Fe2 is set to "0" (in the case of there being no abnormal events), the signal decoding unit 35 executes the decoding process and outputs obtained playback audio signal. The playback audio signal is supplied to the contact point A of the switch 39, the signal buffer 36, and the signal synthesizing unit 38. At step S24, the signal buffer 36 stores the playback audio signal.

At step S25, the signal analyzing unit 37 performs a signal analyzing process. The details of the signal analyzing process are shown by the flow chart in FIG. 7.

Figure 7:
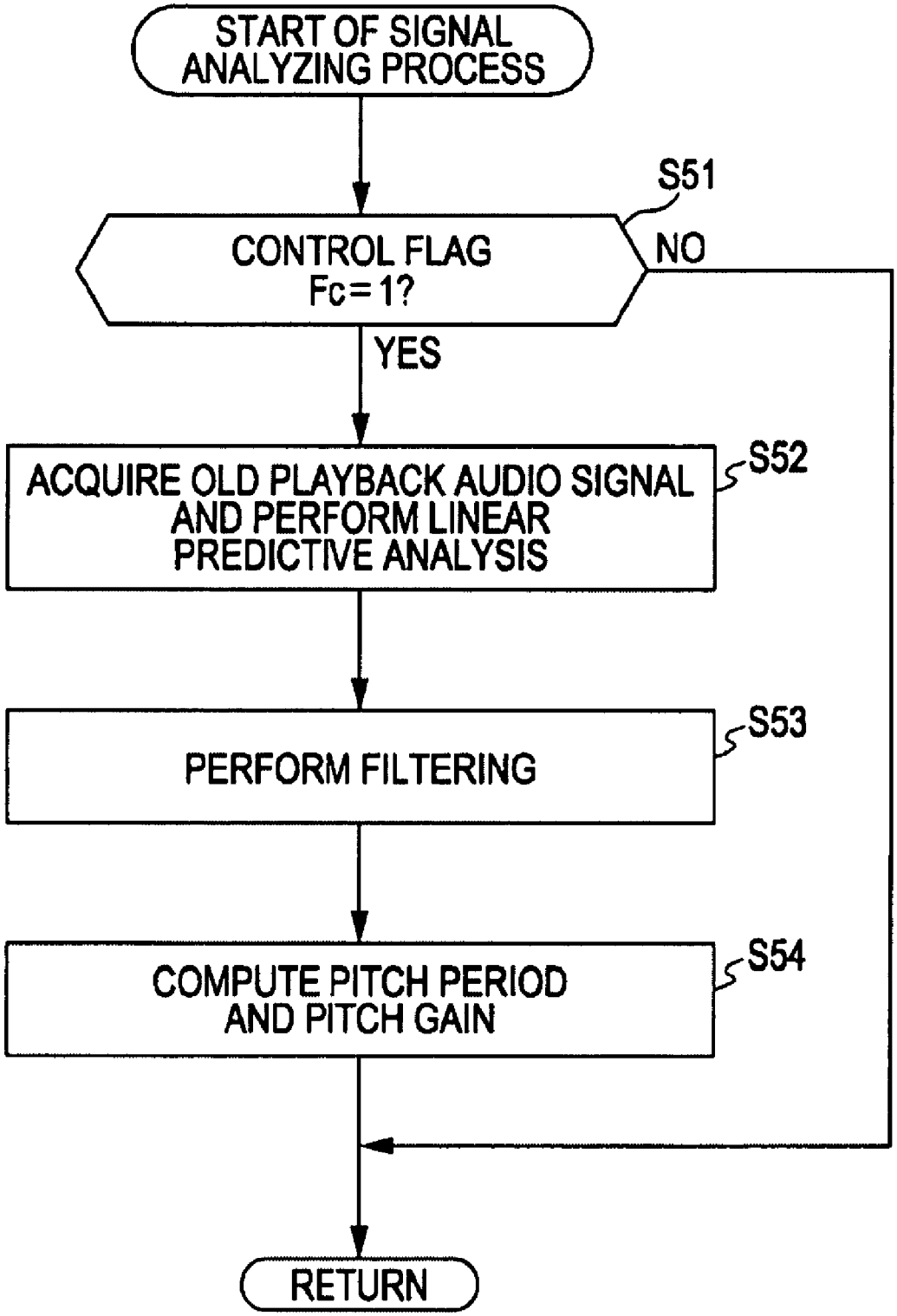
FIG. 7 is a flow chart illustrating a signal analyzing process.

At step S51 in FIG. 7, the linear predictive analysis unit 61 determines whether the control flag Fc is set to "1". If the control flag Fc supplied from the packet decomposition unit 34 is set to "1" (in the case of there being abnormal events), the linear predictive analysis unit 61, at step S52, acquires the old playback audio signal from the signal buffer 36 so as to perform a linear predictive analysis. That is, by applying the linear predictive filter expressed by equation (1) to an old playback audio signal s[n], which is a normal playback audio signal of the latest frame among frames preceding the current frame, the linear predictive analysis unit 61 generates a filtered linear predictive residual signal r[n] and derives the linear predictive coefficient $a_i$ of the pth-order linear predictive filter. The linear predictive residual signal r[n] is supplied to the filter 62, the FFT unit 102, and the signal repeating unit 107. The linear predictive coefficient $a_i$ is supplied to the LPC synthesis unit 110.

Figure 8A:
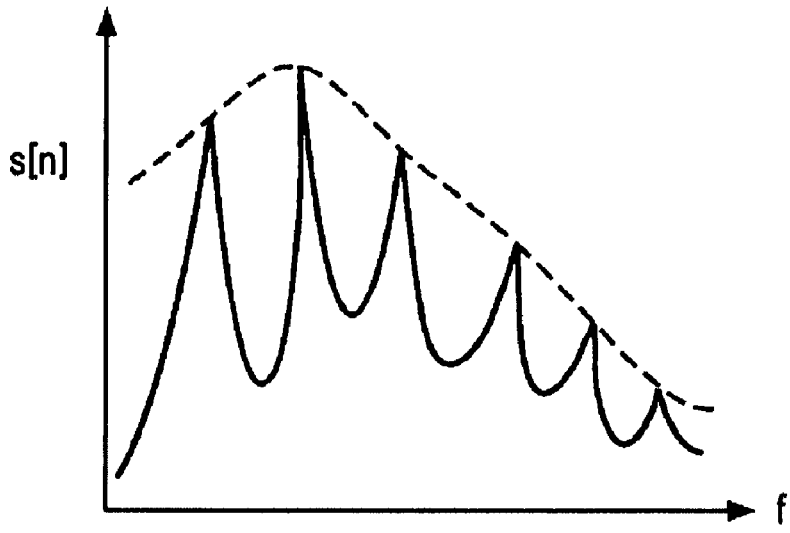
FIGS. 8A and 8B are diagrams illustrating a filtering process.
Figure 8B:
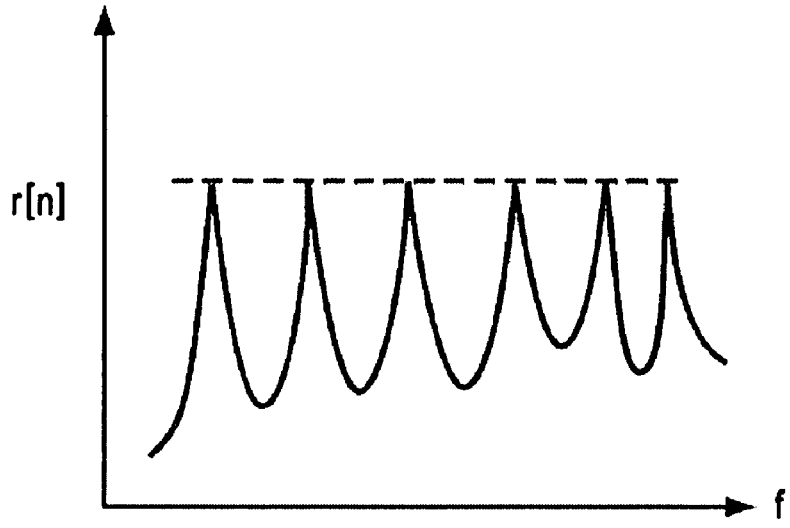

For example, when the linear predictive filter expressed by equation (1) is applied to the old playback audio signal s[n] having different peak values for different frequency ranges, as shown in FIG. 8A, the linear predictive residual signal r[n] filtered so that the peak values are aligned at substantially the same level can be generated.

Figure 9:
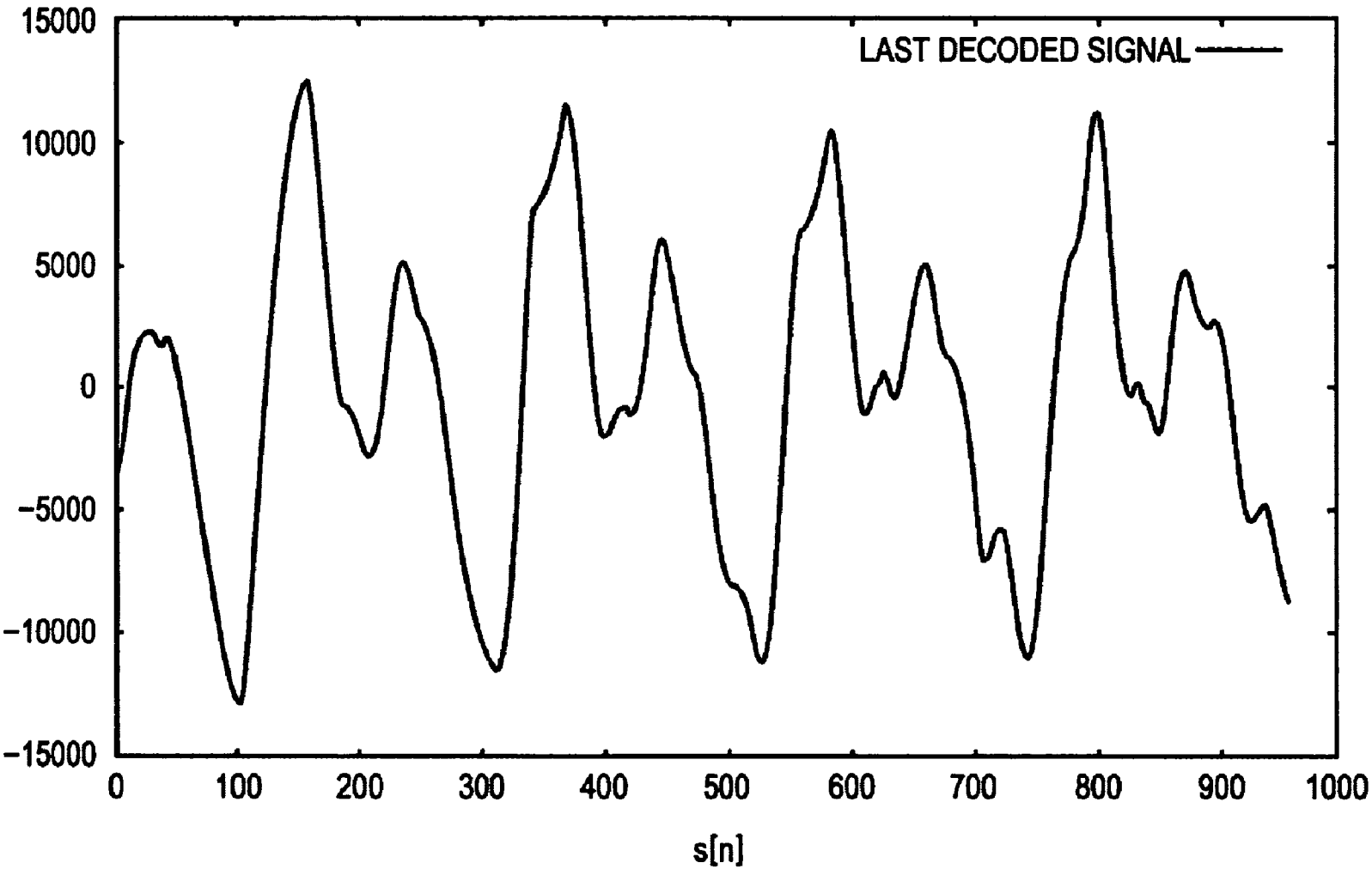
FIG. 9 illustrates an example of an old playback audio signal.

Furthermore, for example, when, as shown in FIG. 9, a normal playback audio signal of the latest frame among frames that are preceding a frame including the encoded data received abnormally has a sampling frequency of 48 kHz and 960 samples in a frame, this playback audio signal is stored in the signal buffer 36. The playback audio signal shown in FIG. 9 has high periodicity, such as that shown in a vowel. This playback audio signal, which serves as an old playback audio signal, is subjected to a linear predictive analysis. As a result, the linear predictive residual signal r[n] shown in FIG. 10 is generated.

As noted above, when detecting an error or data loss in a transmission path, the packet voice communication apparatus 1 can analyze the decoded signal obtained from an immediately preceding normal reception data and generate a periodic residual signal $r_H$[n], which serves as a component repeated by the pitch period "pitch", by generating the linear predictive residual signal r[n]. In addition, the packet voice communication apparatus 1 can generate a noise-like residual signal r"[n], which serves as a strongly noise-like component. Subsequently, the packet voice communication apparatus 1 sums the linear predictive residual signal r[n] and the noise-like residual signal r"[n] so as to generate a linear predictive synthesized signal $S_A[n]$. Thus, if information is lost due to some error or data loss, the packet voice communication apparatus 1 can output the generated linear predictive synthesized signal $S_A[n]$ in place of the real decoded signal of the reception data in the lost data period.

At step S53, the filter 62 filters the linear predictive residual signal r[n] using a predetermined filter so as to generate a filtered linear predictive residual signal $r_L[n]$. For example, a lowpass filter that can extract low-frequency components (e.g., a pitch period) from the residual signal, which generally contains a large number of high-frequency components, can be used for the predetermined filter. At step S54, the pitch extraction unit 63 computes the pitch period and the pitch gain. That is, according to equation (2), the pitch extraction unit 63 multiplies the filtered linear predictive residual signal $r_L[n]$ by the window function h[n] so as to obtain a windowed residual signal $r_w[n]$. In addition, according to equation (3), the pitch extraction unit 63 computes the autocorrelation ac[L] of the windowed residual signal $r_w[n]$ using equation (3). Subsequently, the pitch extraction unit 63 determines the maximum value of the autocorrelation ac[L] to be the pitch gain pch_g and determines the sample number L when the autocorrelation ac[L] becomes maximum to be the pitch period "pitch". The pitch gain pch_g is supplied to the signal repeating unit 107 and the multipliers 106 and 108. The pitch period "pitch" is supplied to the signal repeating unit 107.

Figure 10:
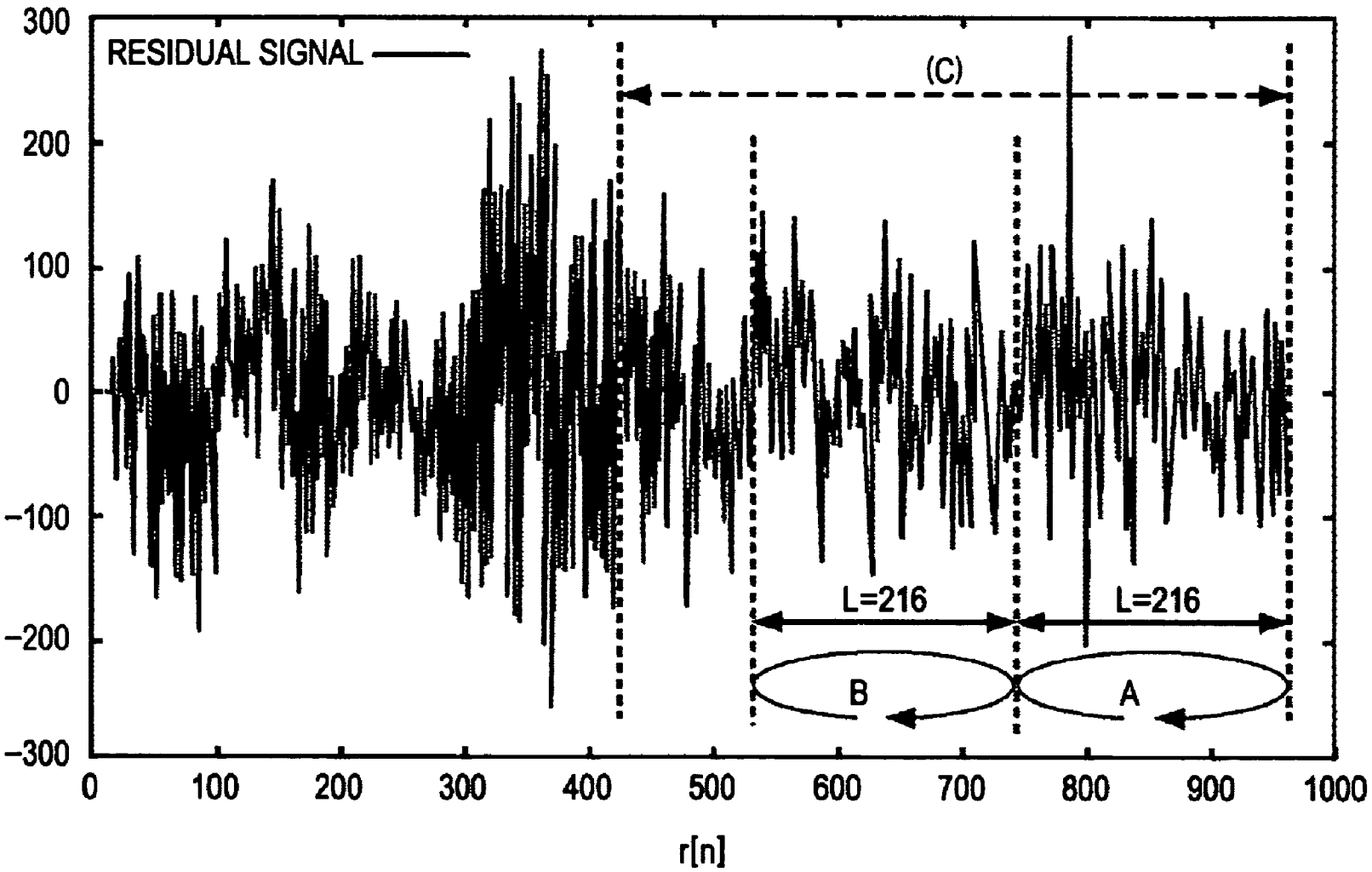
FIG. 10 illustrates an example of a linear predictive residual signal.
Figure 11:
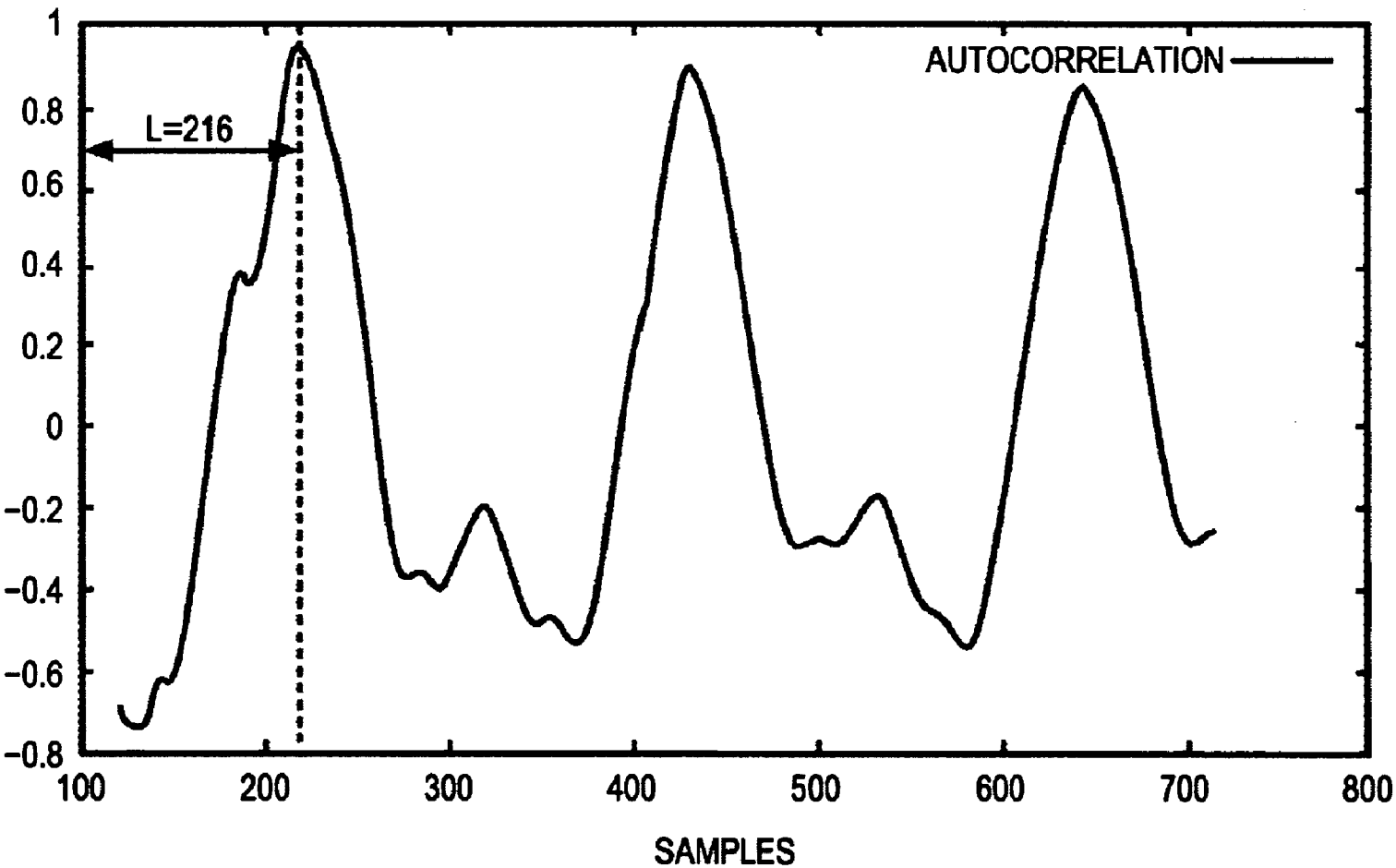
FIG. 11 illustrates an example of the autocorrelation.

FIG. 11 illustrates the autocorrelation ac[L] computed for the linear predictive residual signal r[n] shown in FIG. 10. In this case, the maximum value is about 0.9542. The sample number L is 216. Accordingly, the pitch gain pch_g is 0.9542. The pitch period "pitch" is 216. The solid arrow in FIG. 10 represents the pitch period "pitch" of 216 samples.

Referring back to FIG. 6, after the signal analyzing process is performed at step S25 in the above-described manner, the signal synthesizing unit 38, at step S26, performs a signal synthesizing process. The signal synthesizing process is described in detail below with reference to FIG. 12. Through the signal synthesizing process, the synthesized audio signal $S_H''[n]$ is generated on the basis of the feature parameters, such as the linear predictive residual signal r[n], the linear predictive coefficient $a_i$, the pitch period "pitch", and the pitch gain pch_g.

At step S27, the switch 39 determines whether the output control flag Fco is "1". If the output control flag Fco output from the state control unit 101 is "0" (in a normal case), the switch 39, at step S29, is switched to the contact point A. Thus, the playback audio signal decoded by the signal decoding unit 35 is supplied to the output unit 40 through the contact point A of the switch 39, and therefore, the corresponding sound is output.

In contrast, if the output control flag Fco output from the state control unit 101 is "1" (in an abnormal case), the switch 39, at step S28, is switched to the contact point B. Thus, the synthesized audio signal $S_H''[n]$ synthesized by the signal synthesizing unit 38 is supplied to the output unit 40 through the contact point B of the switch 39 in place of the playback audio signal, and therefore, the corresponding sound is output. Accordingly, even when a packet is lost in the network 2, the sound can be output. That is, the affect due to the packet loss can be reduced.

The signal synthesizing process performed at step S26 in FIG. 6 is described in detail next with reference to FIGS. 12 and 13. This signal synthesizing process is performed for each of the frames.

At step S81, the state control unit 101 sets the initial value of an error status ES to "0". This process is performed only for a head frame immediately after the decoding process is started, and is not performed for the frames subsequent to the second frame. At step S82, the state control unit 101 determines whether the second error flag Fe2 supplied from the packet decomposition unit 34 is "0". If the second error flag Fe2 is "1", not "0" (i.e., if an error has occurred), the state control unit 101, at step S83, determines whether the error status is "0" or "−1".

This error status to be determined is an error status of the immediately preceding frame, not the current frame. The error status of the current frame is set at step s86, S89, S92, S94, or S95. While, the error status determined at step S104 is the error status of the current frame, which is set at step S86, S89, S92, S94, or S95.

If the immediately preceding error status is "0" or "−1", the immediately preceding frame has been normally decoded. Accordingly, at step S84, the state control unit 101 sets the control flag Fc to "1". The control flag Fc is delivered to the linear predictive analysis unit 61.

At step S85, the signal synthesizing unit 38 acquires the feature parameters from the signal analyzing unit 37. That is, the linear predictive residual signal r[n] is supplied to the FFT unit 102 and the signal repeating unit 107. The pitch gain pch_g is supplied to the signal repeating unit 107 and the multipliers 106 and 108. The pitch period "pitch" is supplied to the signal repeating unit 107. The linear predictive coefficient $a_i$ is supplied to the LPC synthesis unit 110.

Figure 14:
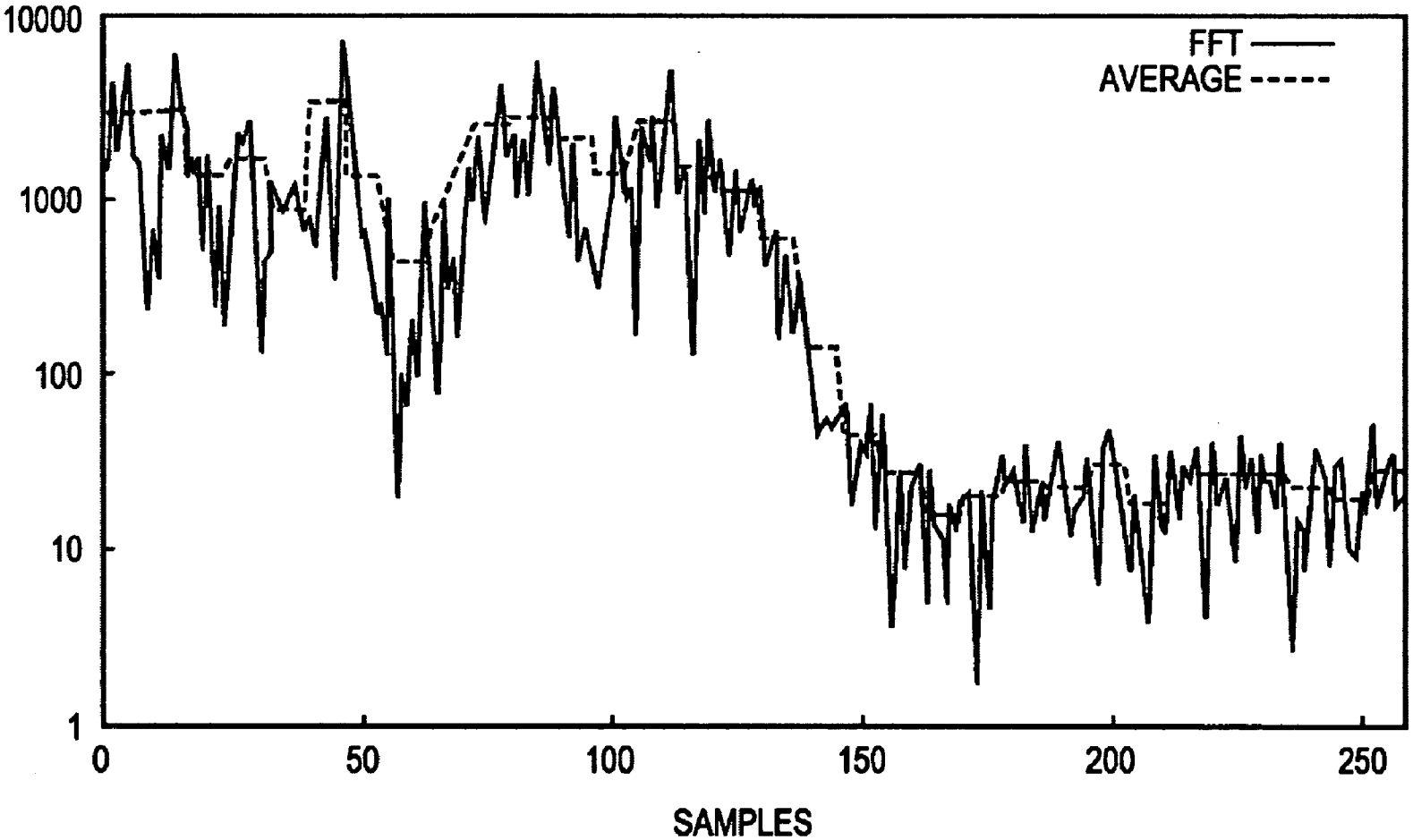
FIG. 14 illustrates an example of a Fourier spectrum signal.

At step S86, the state control unit 101 updates an error status ES to "1". At step S87, the FFT unit 102 performs a fast Fourier transform process on the linear predictive residual signal r[n]. Therefore, the FFT unit 102 retrieves the last K samples from the linear predictive residual signal r[0, . . . , N−1], where N is the frame length. Subsequently, the FFT unit 102 multiplies the K samples by a predetermined window function. Thereafter, FFT unit 102 performs a fast Fourier transform process so as to generate the Fourier spectrum signal R[0, . . . , K/2−1]. When the fast Fourier transform process is performed, it is desirable that the value of K is power of two. Accordingly, for example, the last 512 ($=2^9$) samples (512 samples from the right in FIG. 10) in the range C, as shown by a dotted arrow in FIG. 10, can be used. FIG. 14 illustrates an example of the result of such a fast Fourier transform operation.

At step S88, the spectrum smoothing unit 103 smoothes the Fourier spectrum signal so as to compute a smooth Fourier spectrum signal R'[k]. This smoothing operation smoothes the Fourier spectrum amplitude for every M samples as follows.

$$|R'[k_0 \cdot M + k_1]| = \frac{g[k_0]}{M} \sum_{m=0}^{M-1} |R[k_0 \cdot M + m]| \tag{4}$$

$$k0 = 0, 1, \ldots, \frac{\frac{k}{2}}{M} - 1$$

$$k1 = 0, 1, \ldots, M - 1$$

Here, $g[k_0]$ in equation (4) denotes a weight coefficient for each spectrum.

In FIG. 14, a stepped line denotes an average value for every M samples.

At step S83, if the error status is neither "0" nor "−1" (i.e., if the error status one of "−2", "1", and "2"), an error has occurred in the preceding frame or in the two successive preceding frames. Accordingly, at step S89, the state control unit 101 sets the error status ES to "2" and sets the control flag Fc to "0", which indicates that signal analysis is not performed.

If, at step S82, it is determined that the second error flag Fe2 is "0" (i.e., in the case of no errors), the state control unit 101, at step S90, sets the control flag Fc to "0". At step S91, the state control unit 101 determines whether the error status ES is less than or equal to zero. If the error status ES is not less than or equal to zero (i.e., if the error status ES is one of "2" and "1"), the state control unit 101, at step S92, sets the error status ES to "−2".

However, if, at step S91, it is determined that the error status ES is less than or equal to zero, the state control unit 101, at step S93, determines whether the error status ES is greater than or equal to "−1". If the error status ES is less than "−1" (i.e., if the error status ES is "−2"), the state control unit 101, at step S94, sets the error status ES to "−1".

However, if, at step S93, it is determined that the error status ES is greater than or equal to "−1" (i.e., if the error status ES is one of "0" and "−1"), the state control unit 101, at step S95, sets the error status ES to "0". In addition, at step S96, the state control unit 101 sets the output control flag Fco to "0". The output control flag Fco of "0" indicates that the switch 39 is switched to the contact point A so that the playback audio signal is selected (see steps S27 and S29 shown in FIG. 6).

After the processes at steps S88, S89, S92, and S94 are completed, the noise-like spectrum generation unit 104, at step S97, randomizes the phase of the smooth Fourier spectrum signal R'[k] output from the spectrum smoothing unit 103 so as to generate a noise-like spectrum signal R"[k]. At step S98, the IFFT unit 105 performs an inverse fast Fourier transform process so as to generate a noise-like residual signal r"[0, . . . , N−1]. That is, the frequency spectrum of the linear predictive residual signal is smoothed. Thereafter, the frequency spectrum having a random phase is transformed into a time domain so that the noise-like residual signal r "[0, . . . , N−1] is generated.

As described above, when the phase of the signal is randomized or certain noise is provided to the signal, a natural sounding voice can be output.

Figure 15:
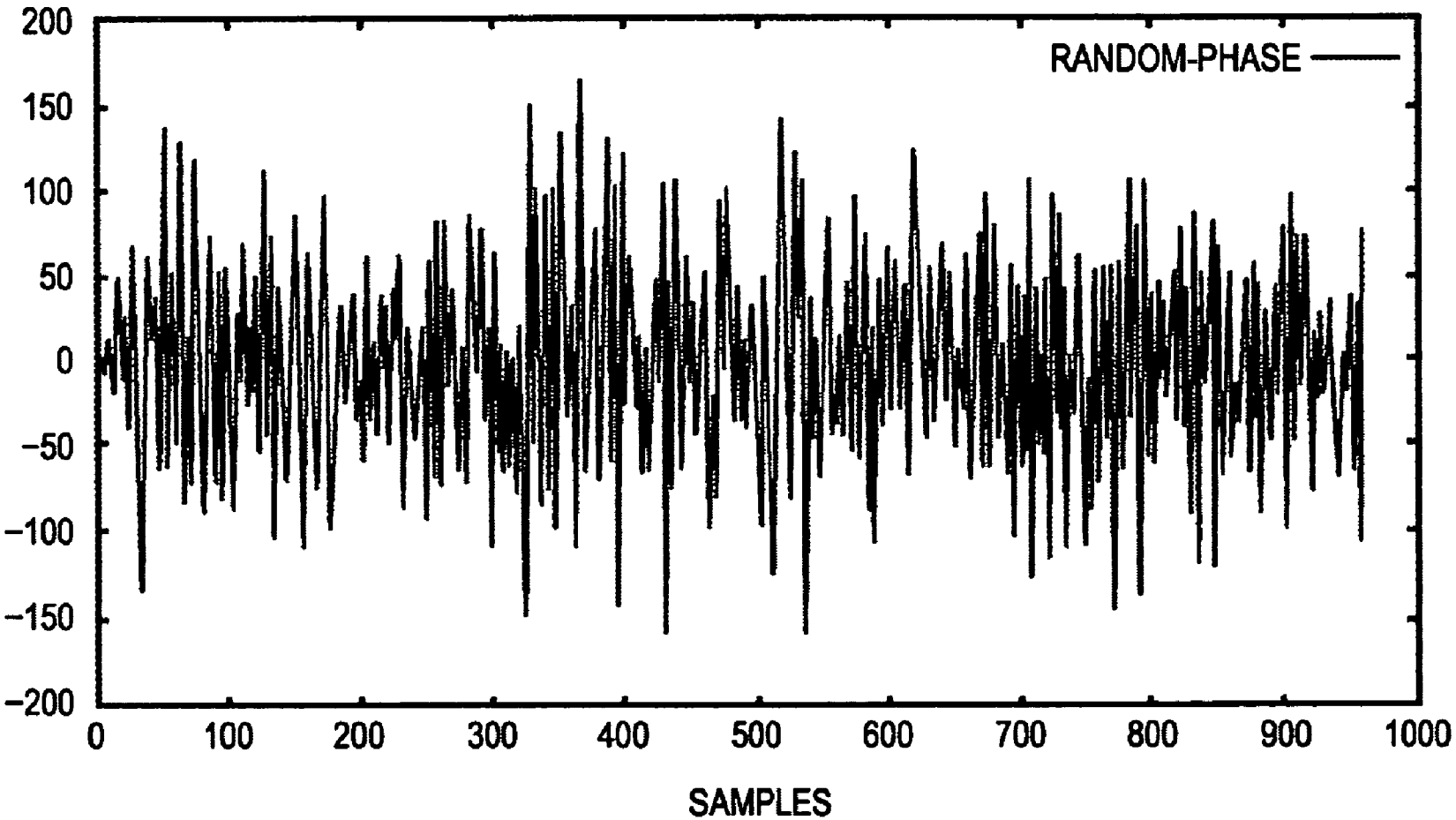
FIG. 15 illustrates an example of a noise-like residual signal.

FIG. 15 illustrates an example of a noise-like residual signal obtained through an operation in which the average FFT amplitude shown in FIG. 14 is multiplied by an appropriate weight coefficient g[k], a random phase is added to the resultant value, and the resultant value is subjected to an inverse fast Fourier transform.

At step S99, the signal repeating unit 107 generates a periodic residual signal. That is, by repeating the linear predictive residual signal r[n] on the basis of the pitch period, a periodic residual signal $r_H[0, \ldots, N-1]$ is generated. FIG. 10 illustrates this repeating operation using arrows A and B. In this case, if the pitch gain pch_g is greater than or equal to a predetermined reference value, that is, if an obvious pitch period can be detected, the following equation is used:

$$r_H[n] = r\left[N - \left[\frac{n + s \cdot N + L}{L}\right] \cdot L + n + s \cdot N\right] \tag{5}$$

-continued $$n = 0, 1, \ldots, N-1$$

$$s = 0, 1, \ldots$$

where s denotes the frame number counted after the error status is changed to "1" most recently.

Figure 16:
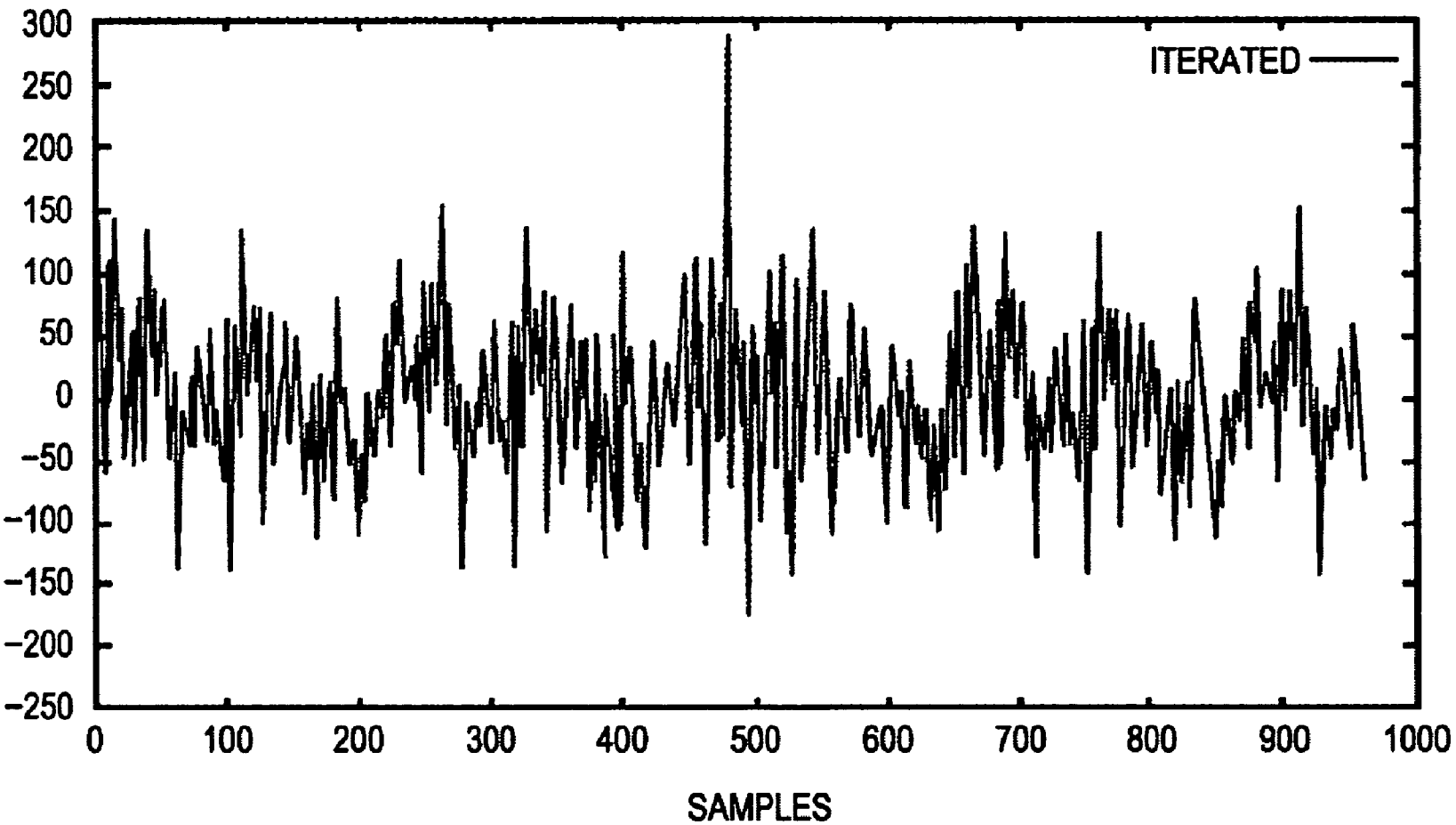
FIG. 16 illustrates an example of a periodic residual signal.

FIG. 16 illustrates an example of a periodic residual signal generated in the above-described manner. As shown by the arrow A in FIG. 10, the last one period can be repeated. However, instead of repeating the last period, the period shown by the arrow B may be repeated. Thereafter, by mixing the signals in the two periods in an appropriate proportion, a periodic residual signal can be generated. FIG. 16 illustrates an example of the periodic residual signal in the latter case.

If the pitch gain pch_g is less than the predetermined reference value, that is, if an obvious pitch period cannot be detected, a periodic residual signal can be generated by reading out the linear predictive residual signal at random positions using the following equations:

$$r_H[n] = r[N - q + n] \tag{6}$$

$$n = 0, 1, \ldots, \frac{N}{2} - 1$$

$$r_H[n] = r\left[\frac{N}{2} - q' + n\right] \tag{7}$$

$$n = \frac{N}{2}, \frac{N}{2} + 1, \ldots, N-1$$

where q and q' are integers randomly selected in the range from N/2 to N.

In this example, the signal for one frame is obtained from the linear predictive residual signal twice. However, the signal for one frame may be obtained more times.

In addition, the number of discontinuities may be reduced by using an appropriate signal interpolation method.

By reducing the number of discontinuities, a more natural sounding voice can be output.

At step S100, the multiplier 108 multiplies the periodic residual signal $r_H[0, \ldots, N-1]$ by the weight coefficient $\beta_1$. The multiplier 106 multiplies the noise-like residual signal r"[0, . . . , N−1] by the weight coefficient $\beta_2$. These coefficients $\beta_1$ and $\beta_2$ are functions of the pitch gain pch_g. For example, when the pitch gain pch_g is close to a value of "1", the periodic residual signal $r_H[0, \ldots, N-1]$ is multiplied by the weight coefficient $\beta_1$ greater than the weight coefficient $\beta_2$ of the noise-like residual signal r"[0, . . . , N−1]. In this way, the mix ratio between the noise-like residual signal r"[0, . . . , N−1] and the periodic residual signal $r_H[0, \ldots, N-1]$ can be changed in step S101.

At step S101, the adder 109 generates a synthesized residual signal $r_A[0, \ldots, N-1]$ by summing the noise-like residual signal r"[0, . . . , N−1] and the periodic residual signal $r_H[0, \ldots, N-1]$ using the following equation:

$$r_A[n] = \beta_1 \cdot r_H[n] + \beta_2 \cdot r''[n] \tag{8}$$

n=0, . . . , N−1

That is, the periodic residual signal $r_H[0, \ldots, N-1]$ generated by repeating the linear predictive residual signal r[n] on the basis of the pitch period "pitch" is added to the noise-like residual signal r"[0, . . . , N−1] generated by smoothing the frequency spectrum of the linear predictive residual signal and transforming the frequency spectrum having a random phase into a time domain in a desired ratio using the coefficients $\beta_1$ and $\beta_2$. Thus, the synthesized residual signal $r_A[0, \ldots, N-1]$ is generated.

Figure 17:
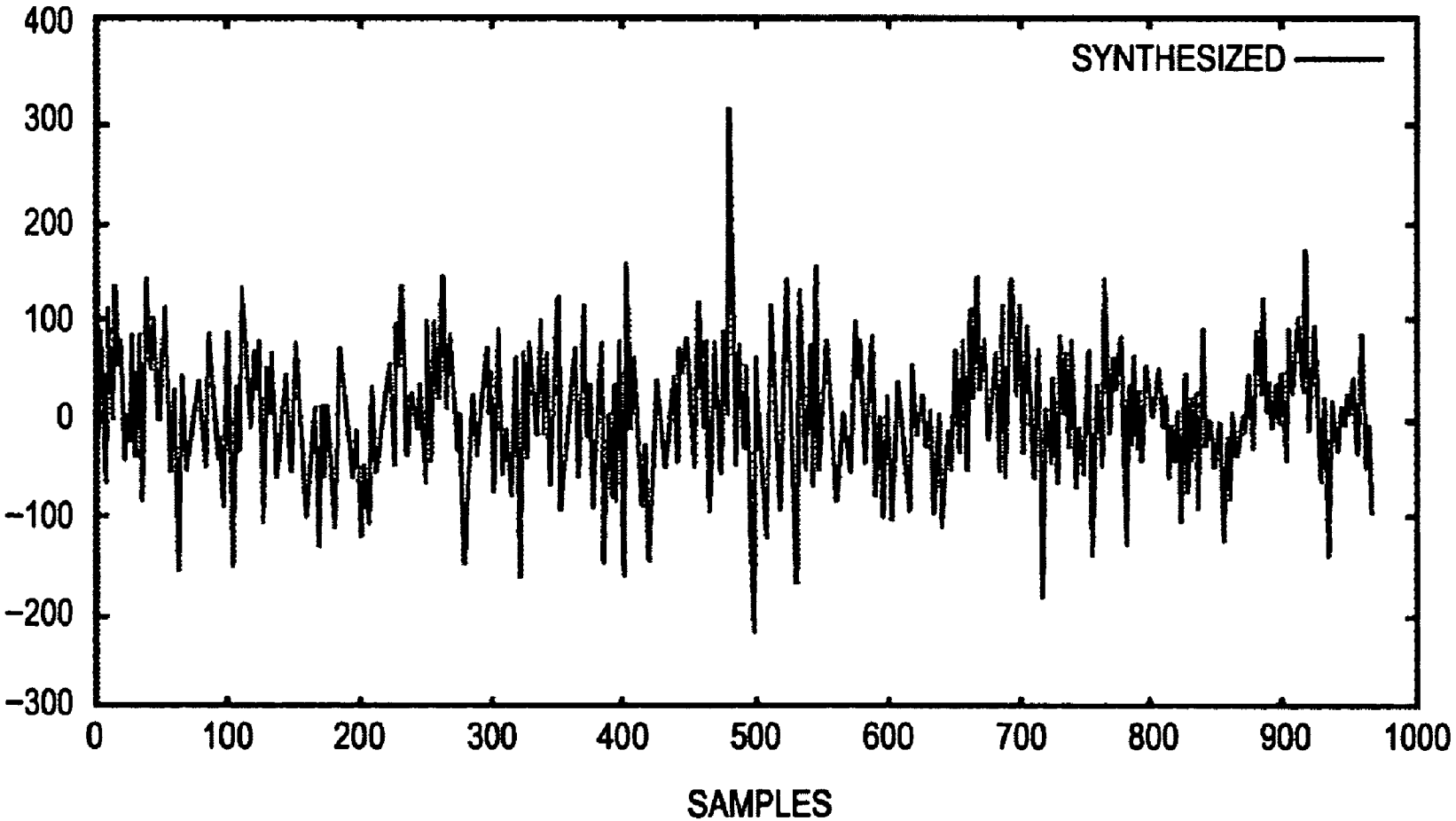
FIG. 17 illustrates an example of a synthesized residual signal.

FIG. 17 illustrates an example of a synthesized residual signal generated by summing the noise-like residual signal shown in FIG. 15 and the periodic residual signal shown in FIG. 16.

At step S102, the LPC synthesis unit 110 generates a linear predictive synthesized signal $S_A[n]$ by multiplying the synthesized residual signal $r_A[0, \ldots, N-1]$ generated by the adder 109 at step S101 by a filter A(z) expressed as follows:

$$A(z) = \frac{1}{1 - \sum_{i=1}^{p} a_i \cdot z^{-i}} \tag{9}$$

where p denotes the order of the LPC synthesis filter.

That is, the linear predictive synthesized signal $S_A[n]$ is generated through the linear predictive synthesis process.

As can be seen from equation (9), the characteristic of the LPC synthesis filter is determined by the linear predictive coefficient $a_i$ supplied from the linear predictive analysis unit 61.

That is, when an error or information loss is detected in a transmission path, a decoded signal acquired from the immediately preceding normal reception data is analyzed, and the periodic residual signal $r_H[0, \ldots, N-1]$, which is a repeated component on the basis of the pitch period "pitch", and the noise-like residual signal $r''[0, \ldots, N-1]$, which is a component having a strong noise property, are summed. Thus, the linear predictive synthesized signal $S_A[n]$ is obtained. As described below, if the information is substantially lost due to an error or data loss, the linear predictive synthesized signal $S_A[n]$ is output in the loss period in place of the real decoded signal of the reception data.

At step S103, the multiplier 111 multiplies the linear predictive synthesized signal $S_A[0, \ldots, N-1]$ by the coefficient $\beta_3$, which varies in accordance with the value of the error status and the elapsed time of the error state, so as to generate a gain-adjusted synthesized signal $S_A'[0, \ldots, N-1]$, as follows:

$$S_A'[n] = \beta_3 \cdot S_A[n] \tag{10}$$

$n = 0, \ldots, N-1$

Thus, for example, if a large number of errors occur, the volume of sound can be decreased. The gain-adjusted synthesized signal $S_A'[0, \ldots, N-1]$ is output to the contact point A of the switch 115 and the multiplier 112.

Figure 18:
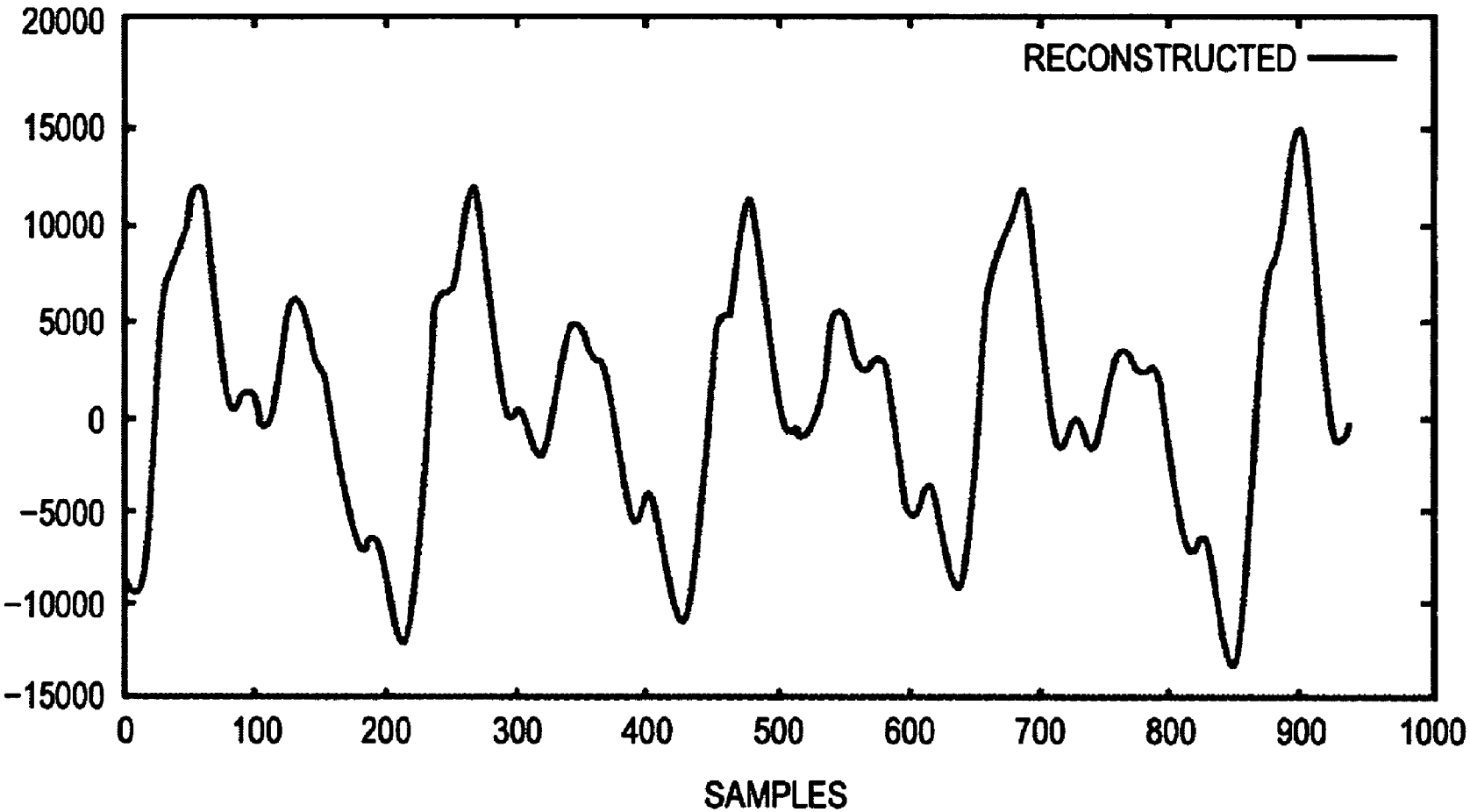
FIG. 18 illustrates an example of a linear predictive synthesized signal.

FIG. 18 illustrates an example of a linear predictive synthesized signal $S_A[n]$ generated in the above-described manner.

At step S104, the state control unit 101 determines whether the error status ES is "−1". This error status to be determined is the error status of the current frame set at step S86, S89, S92, S94, or S95, not the immediately preceding frame. While, the error status determined at step S82 is the error status of the immediately preceding frame.

If the error status ES of the current frame is "−1", the signal decoding unit 35 has normally generated a decoded signal for the immediately preceding frame. Accordingly, at step S105, the multiplier 113 acquires the playback audio signal $S_H[n]$ supplied from the signal decoding unit 35. Subsequently, at step S106, the adder 114 sums the playback audio signal $S_H[n]$ and the gain-adjusted synthesized signal $S_A'[0, \ldots, N-1]$ as follows:

$$S_H'[n] = \beta_4 \cdot S_H[n] + \beta_5 \cdot S_A'[n] \tag{11}$$

$n = 0, \ldots, N-1$

More specifically, the gain-adjusted synthesized signal $S_A'[0, \ldots, N-1]$ is multiplied by the coefficient $\beta_5$ by the multiplier 112. The playback audio signal $S_H[n]$ is multiplied by the coefficient $\beta_4$ by the multiplier 113. The two resultant values are summed by the adder 114 so that a synthesized audio signal $S_H'[n]$ is generated. The generated synthesized audio signal $S_H'[n]$ is output to the contact point B of the switch 115. In this way, immediately after the end of the signal loss period (i.e., in the case of the state in which the second error flag Fe2 is "1" (a signal loss period) followed by the two states in which the second error flag Fe2 is "0" (no signal loss periods), the gain-adjusted synthesized signal $S_A'[0, \ldots, N-1]$ is combined with the playback audio signal $S_H[n]$ in a desired proportion. Thus, smooth signal switching can be provided.

In equation (11), the coefficients $\beta_4$ and $\beta_5$ are weight coefficients of the signals. The coefficients $\beta_4$ and $\beta_5$ are changed as n changes. That is, the coefficients $\beta_4$ and $\beta_5$ are changed for each of the samples.

If, at step S104, the error status ES is not "−1" (i.e., if the error status ES is one of "−2", "0", "1", and "2"), the processes performed at steps S105 and S106 are skipped. When, at step S94, the error status ES is set to "−1", the switch 115 is switched to the contact point B. When, at step S92, S95, S86, or S89, the error status ES is set to one of "−2", "0", "1", and "2", the switch 115 is switched to the contact point A.

Therefore, if the error status ES is "−1" (i.e., if an error is not found in the immediately preceding frame), the synthesized playback audio signal generated at step S106 is output as a synthesized audio signal through the contact point B of the switch 115. In contrast, if the error status ES is one of "−2", "0", "1", and "2" (i.e., if an error is found in the immediately preceding frame), the gain-adjusted synthesized signal generated at step S103 is output as a synthesized audio signal through the contact point A of the switch 115.

After the process performed at step S106 is completed or if, at step S104, it is determined that the error status ES is not "−1", the state control unit 101, at step S107, sets the output control flag Fco to "1". That is, the output control flag Fco is set so that the switch 39 selects the synthesized audio signal output from the signal synthesizing unit 38.

Figure 19:
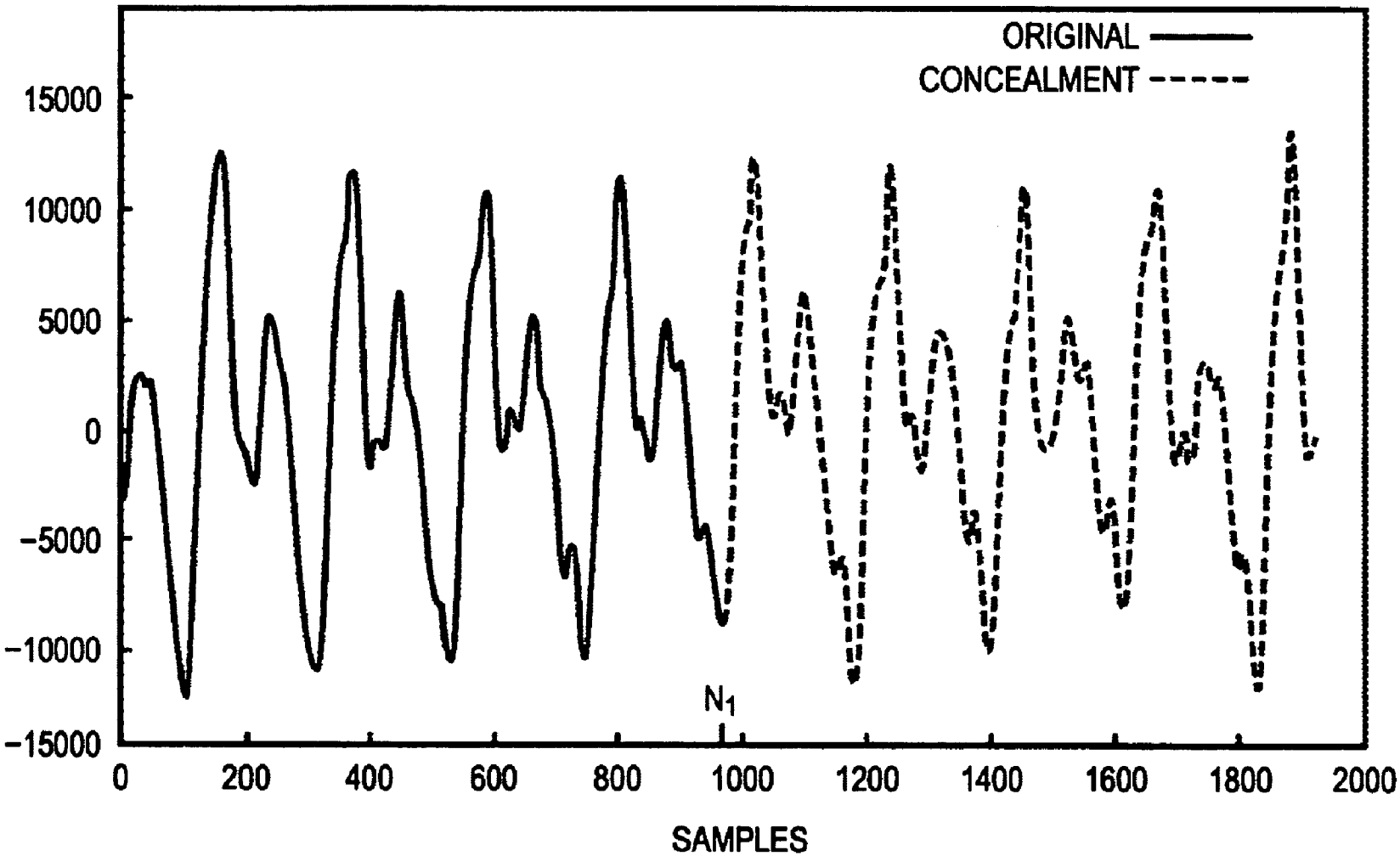
FIG. 19 illustrates an example of an output audio signal.

Subsequently, the switch 39 is switched on the basis of the output control flag Fco. The gain-adjusted synthesized signal $S_A'[n]$, which is obtained by multiplying the linear predictive synthesized signal $S_A[n]$ shown in FIG. 18 by the weight coefficient $\beta_3$ that reduces the amplitude, is output following the sample number $N_1$ of the normal signal shown in FIG. 9. In this way, the output audio signal shown in FIG. 19 can be obtained. Accordingly, the signal loss can be concealed. In addition, the waveform of the synthesized signal following the sample number $N_1$ is similar to that of the preceding normal signal. That is, the waveform is similar to that of a natural sounding voice, and therefore, a natural sounding voice can be output.

When the processes from step S97 to step S107 are performed without performing the processes at steps S84 to S88, that is, when the processes from step S97 to step S107 are performed after the processes at steps S89, S92, and S94 are performed, a new feature parameter is not acquired. In such a case, since the feature parameter of the latest error-free frame has already been acquired and held, this feature parameter is used for the processing.

Figure 20:
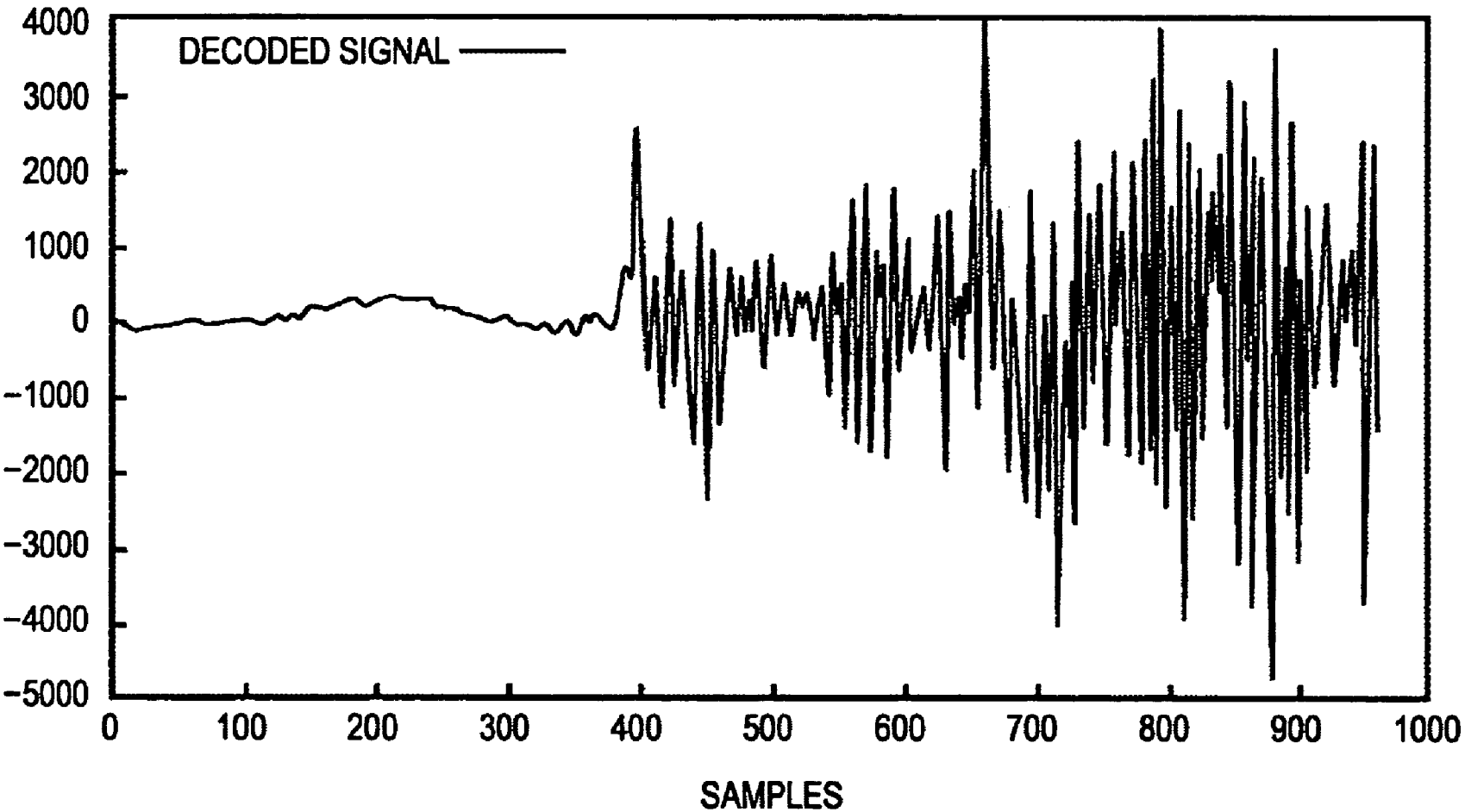
FIG. 20 illustrates an example of an old playback audio signal.

The present invention can be applied to a consonant that has low periodicity in addition to the above-described vowel that has high periodicity. FIG. 20 illustrates a playback audio signal that has low periodicity immediately before reception of normal encoded data fails. As described above, this signal is stored in the signal buffer 36.

This signal shown in FIG. 20 is defined as an old playback audio signal. Subsequently, at step S52 shown in FIG. 7, the linear predictive analysis unit 61 performs a linear predictive process on the signal. As a result, a linear predictive residual signal r[n], as shown in FIG. 21, is generated.

Figure 21:
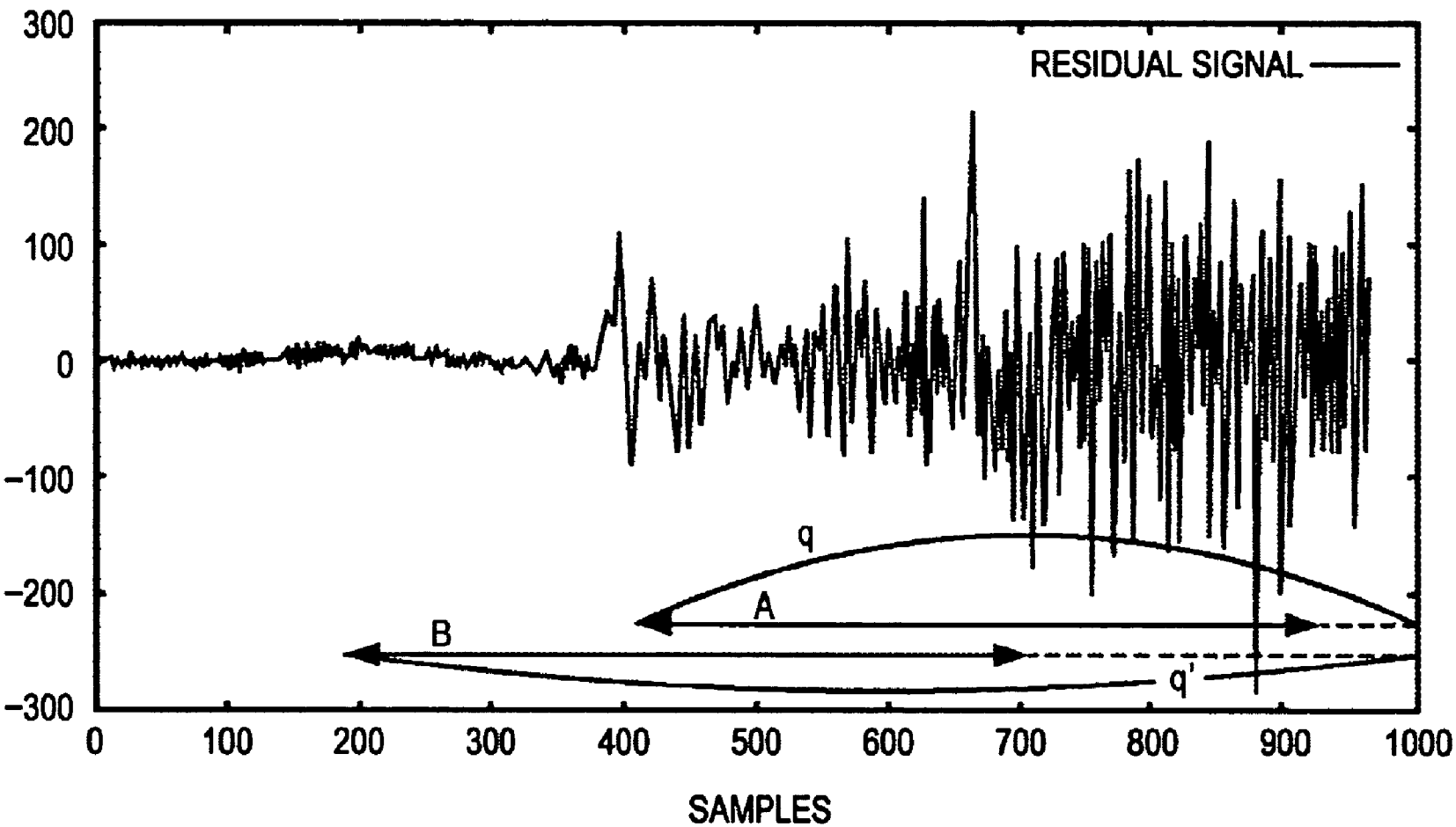
FIG. 21 illustrates an example of a linear predictive residual signal.

In FIG. 21, each of the periods defined by arrows A and B represents a signal readout period starting from any given point. The distance between the left head of the arrow A and the right end of the drawing which ends at the sample number 960 corresponds to "q" in equation (6), while the distance between the left head of the arrow B and the right end of the drawing which ends at the sample number 960 corresponds to "q'" in equation (7).

Figure 22:
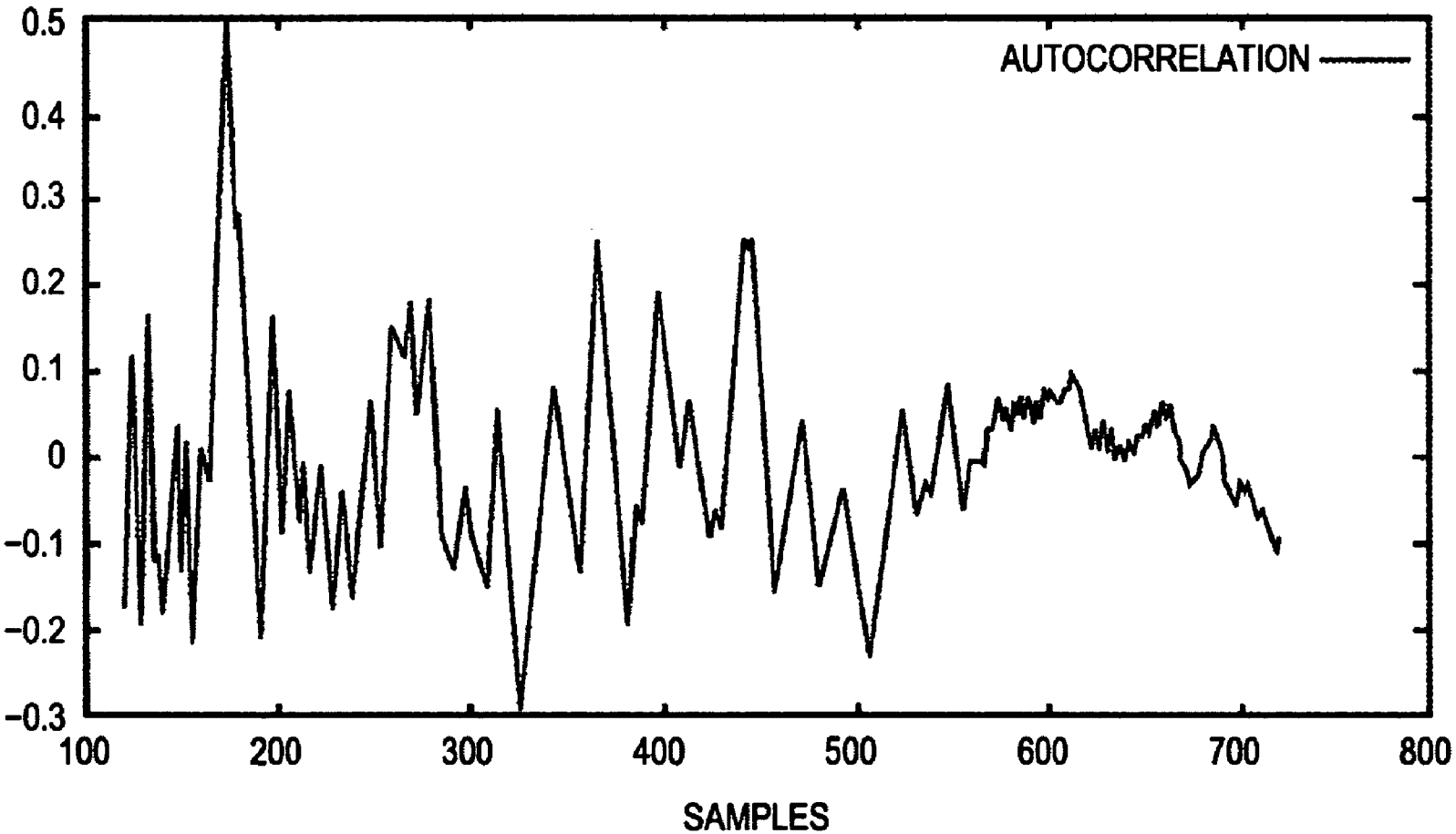
FIG. 22 illustrates an example of the autocorrelation.

The linear predictive residual signal r[n] shown in FIG. 21 is filtered by the filter 62 at step S53. Thus, a filtered linear predictive residual signal $r_L[n]$ is generated. FIG. 22 illustrates the autocorrelation of the filtered linear predictive residual signal $r_L[n]$ computed by the pitch extraction unit 63 at step S54. As can be seen from the comparison between FIG. 22 and FIG. 11, the correlation is significantly low. Accordingly, the signal is not suitable for the repeating process. However, by reading out the linear predictive residual signal at random positions and using equations (6) and (7), a periodic residual signal can be generated.

Figure 12:
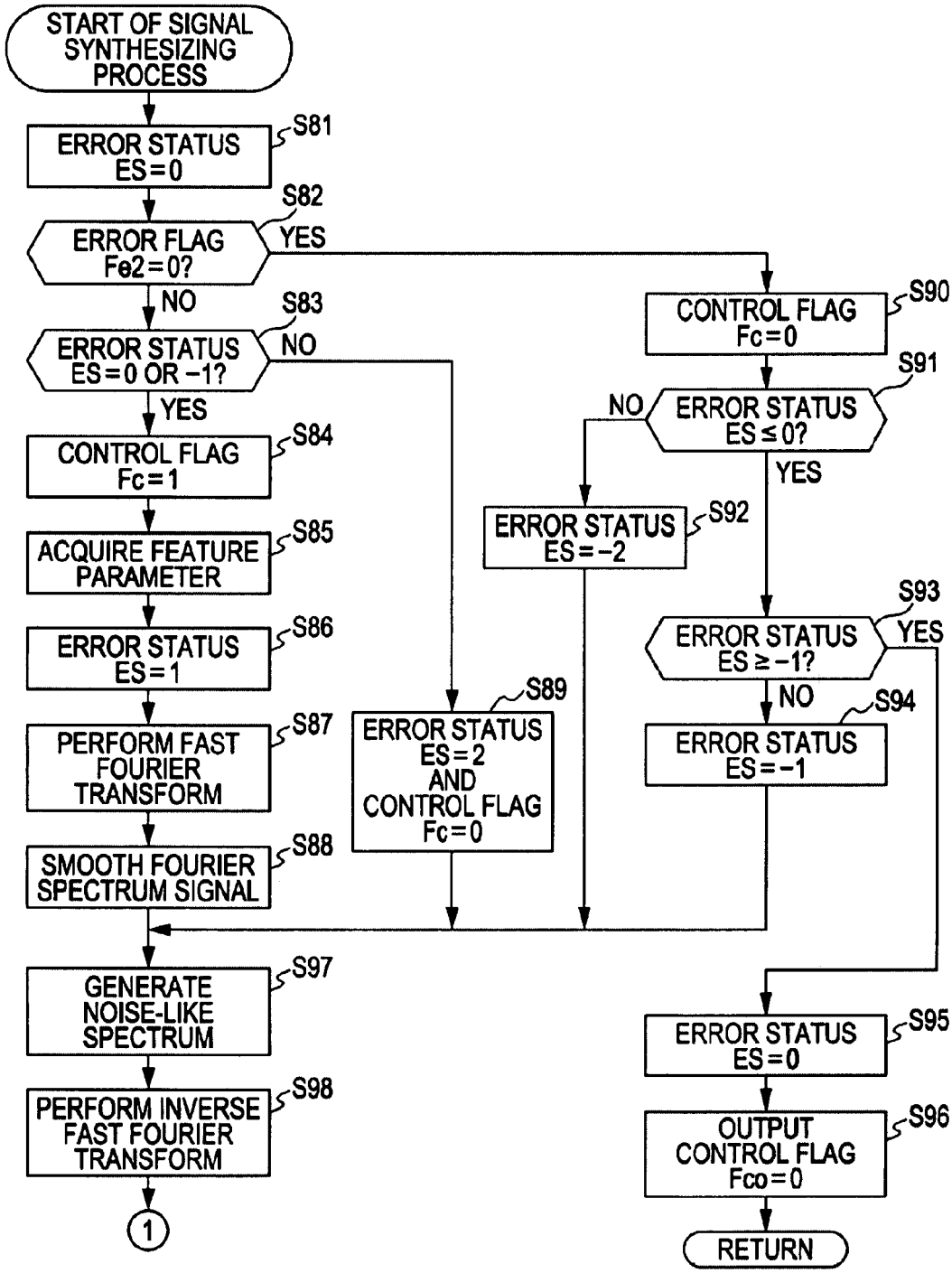
FIG. 12 is a flow chart illustrating a signal synthesizing process.
Figure 13:
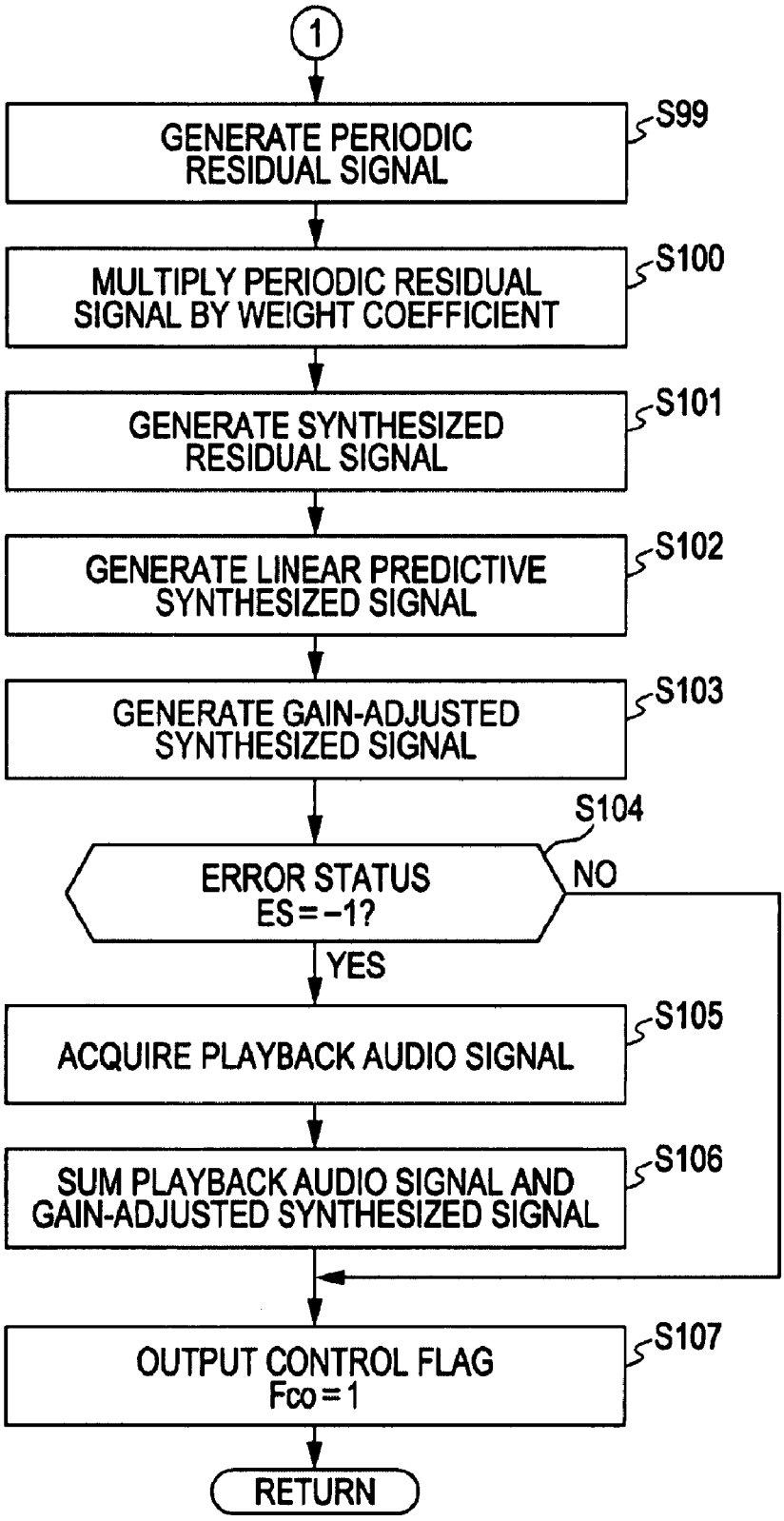
FIG. 13 is a continuation of the flow chart of FIG. 12.
Figure 23:
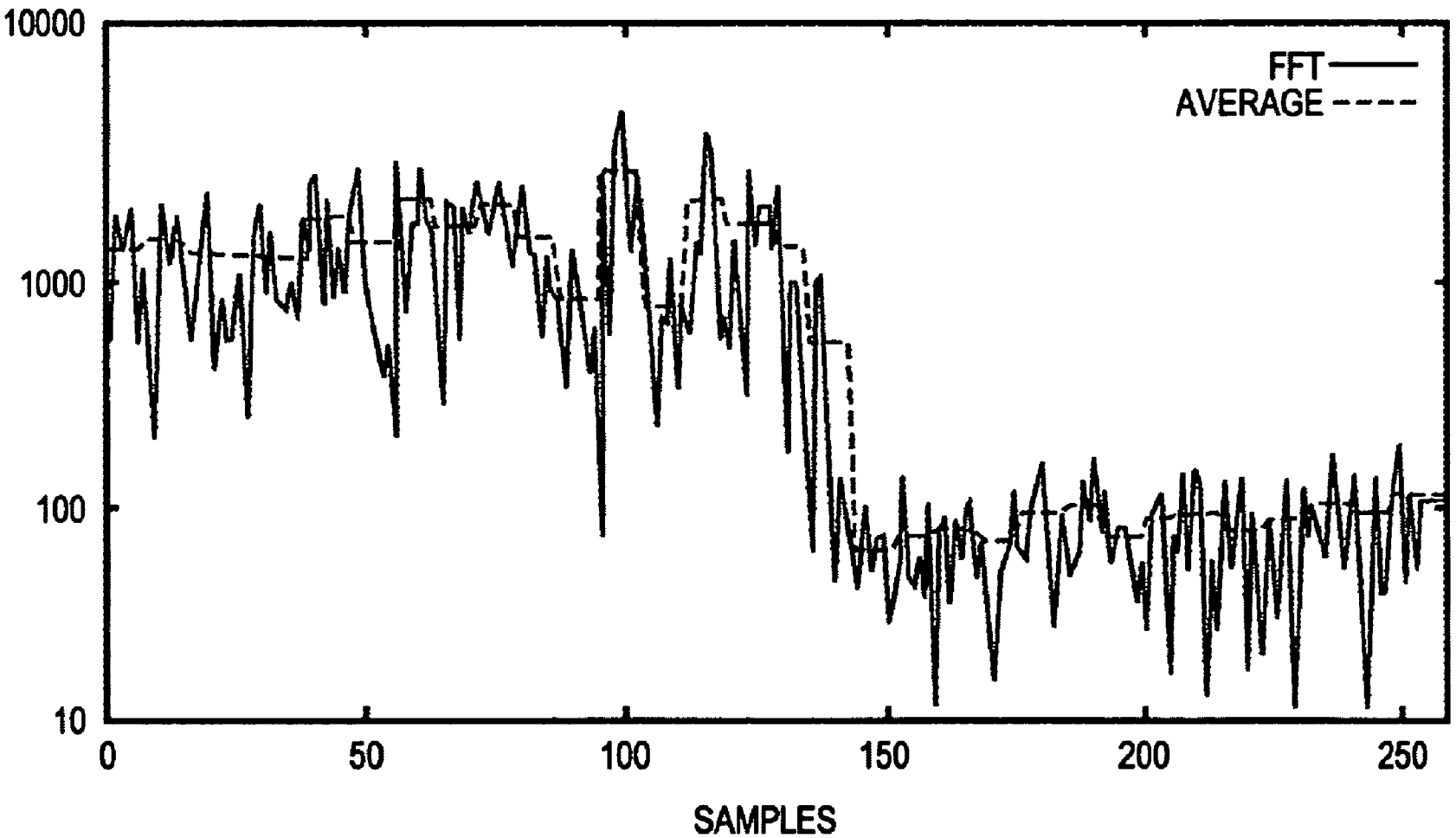
FIG. 23 illustrates an example of a Fourier spectrum signal.

FIG. 23 illustrates the amplitude of a Fourier spectrum signal R[k] obtained by performing a fast Fourier transform on the linear predictive residual signal r[n] shown in FIG. 21 by the FFT unit 102 at step S98 shown in FIG. 12.

Figure 24:
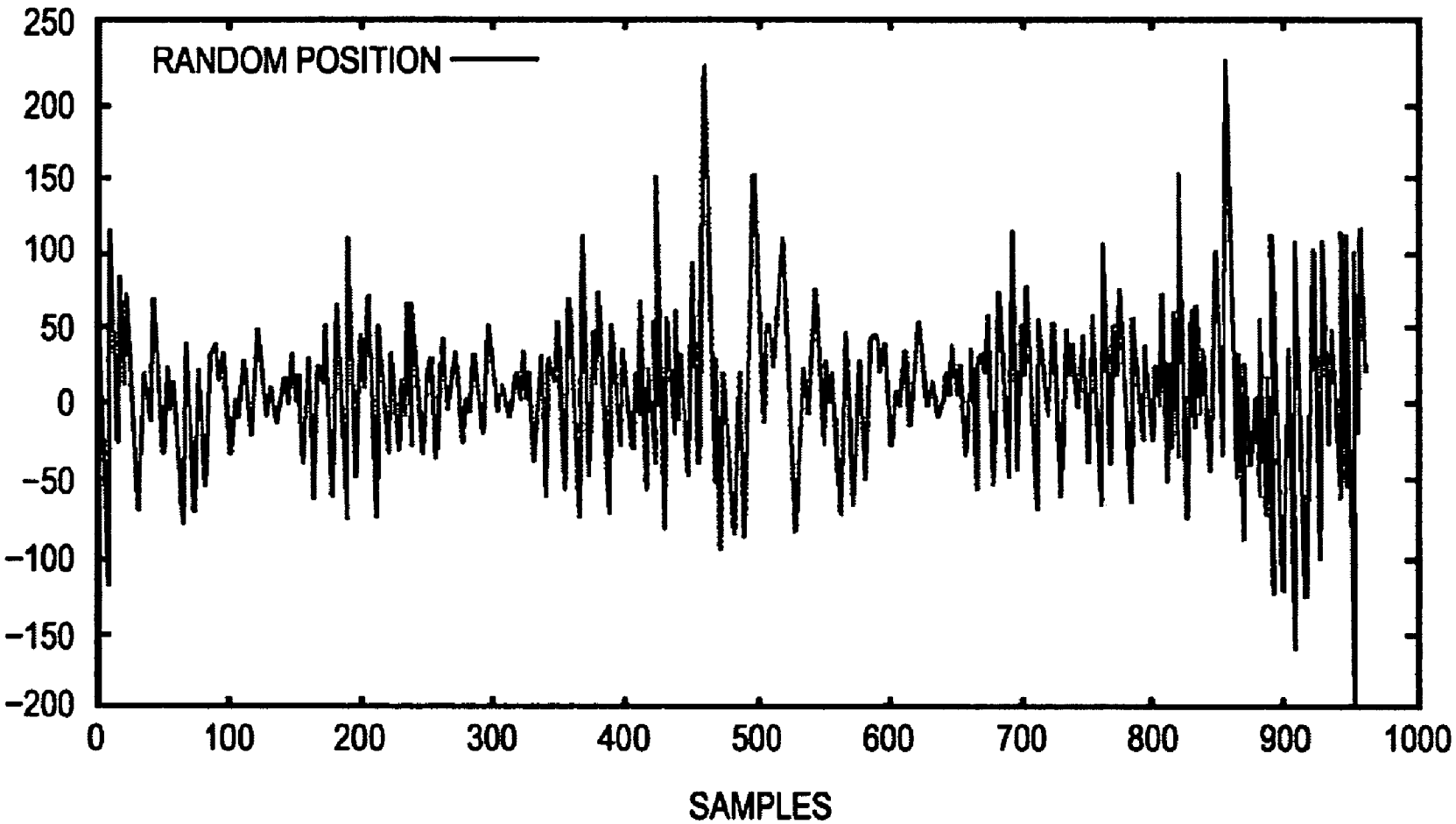
FIG. 24 illustrates an example of a periodic residual signal.

At step S99, the signal repeating unit 107 reads out the linear predictive residual signal r[n] shown in FIG. 21 a plurality of times by randomly changing the readout position, as shown in the periods indicated by the arrows A and B. Thereafter, the readout signals are concatenated. Thus, a periodic residual signal $r_H[n]$ shown in FIG. 24 is generated. As noted above, the signal is read out a plurality of times by randomly changing the readout position and the readout signals are concatenated so that a periodic residual signal having periodicity is generated. Accordingly, even when a signal having low periodicity is lost, a natural sounding voice can be output.

Figure 25:
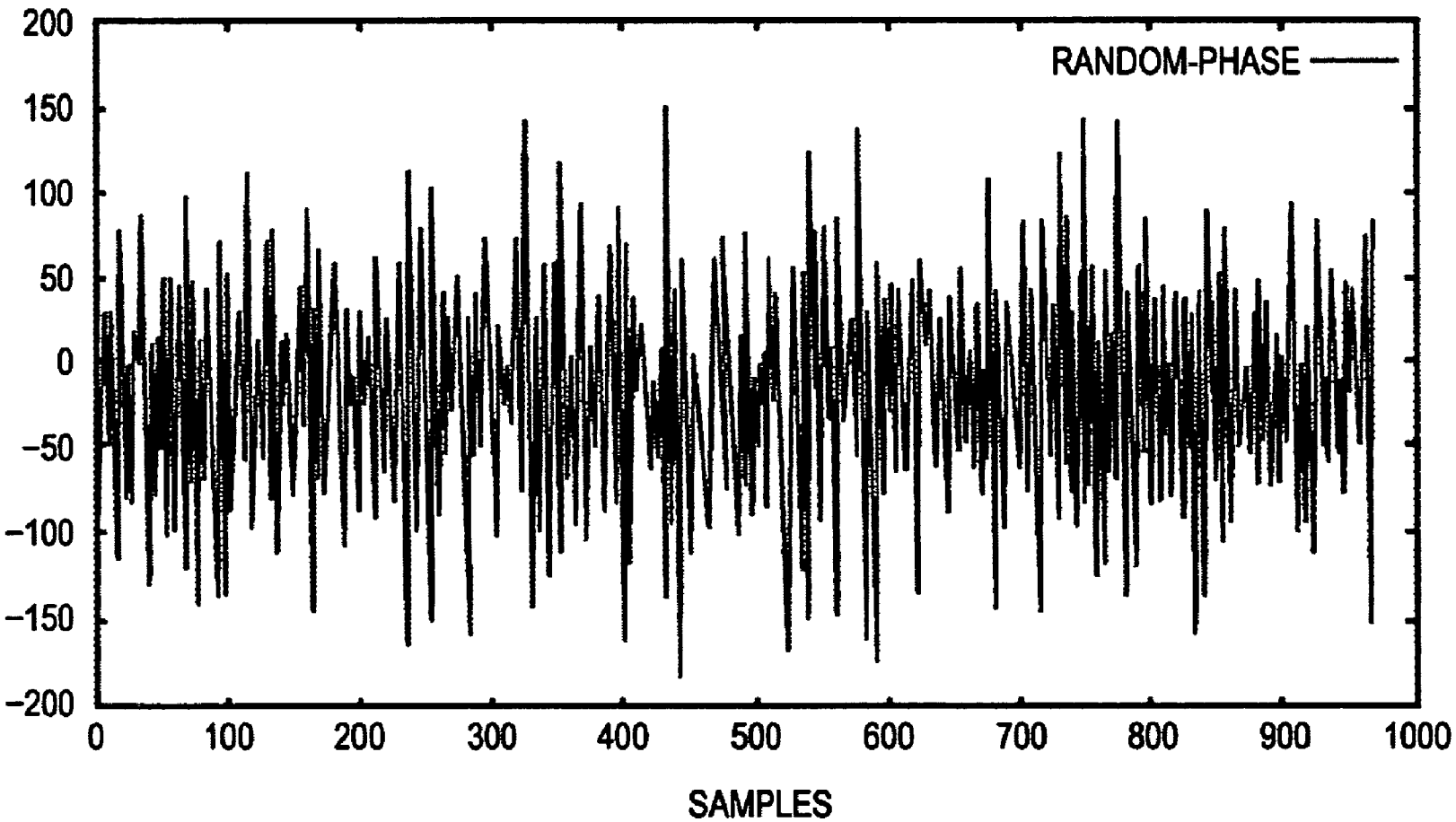
FIG. 25 illustrates an example of a noise-like residual signal.

FIG. 25 illustrates a noise-like residual signal r"[n] generated by smoothing the Fourier spectrum signal R[k] shown in FIG. 23 (step S88), performing a random phase process (step S97), and performing an inverse fast Fourier transform (step S98).

Figure 26:
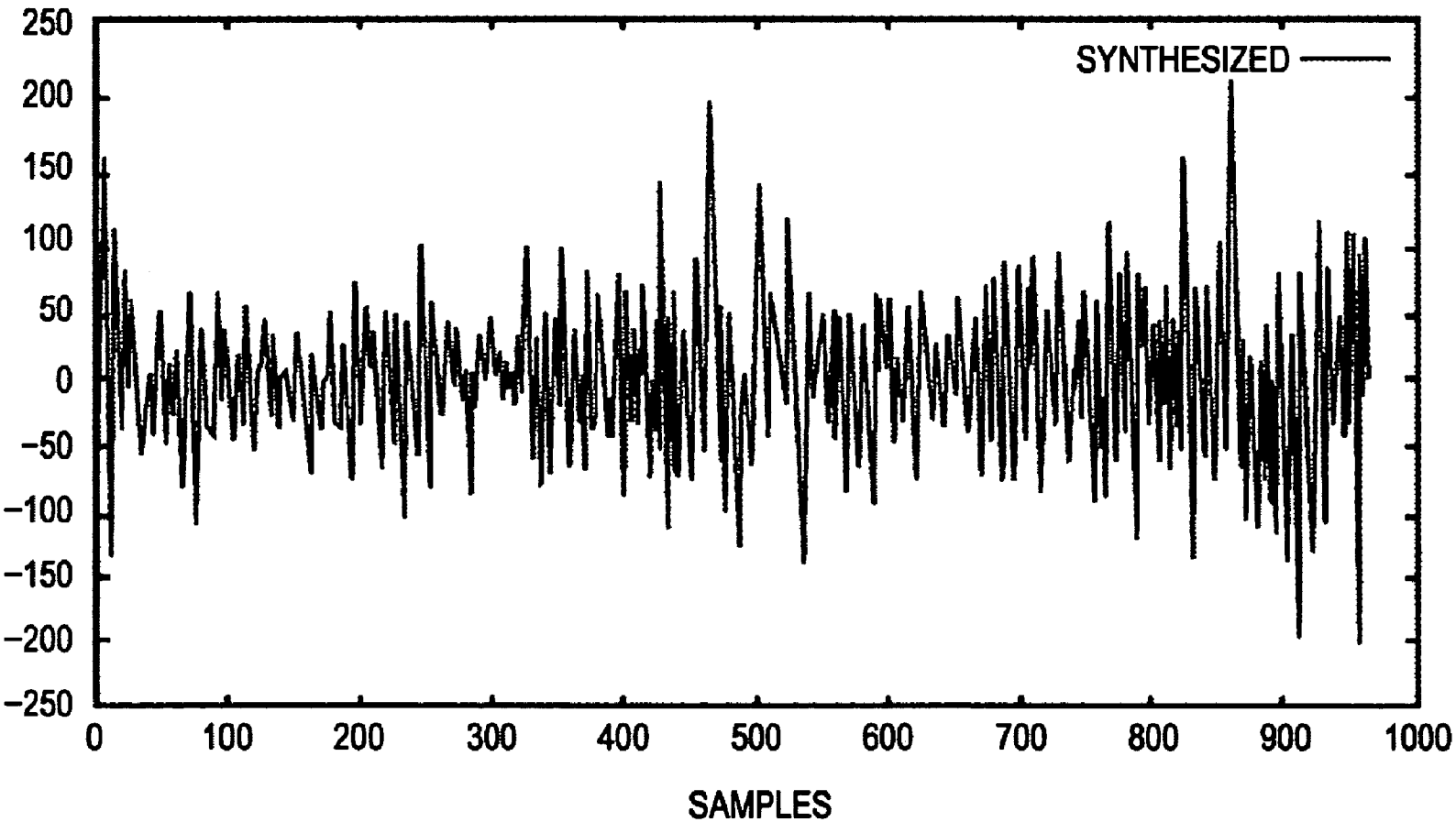
FIG. 26 illustrates an example of a synthesized residual signal.

FIG. 26 illustrates a synthesized residual signal $r_A[n]$ obtained by combining the periodic residual signal $r_H[n]$ shown in FIG. 24 with the noise-like residual signal r"[n] shown in FIG. 25 in a predetermined proportion (step S101).

Figure 27:
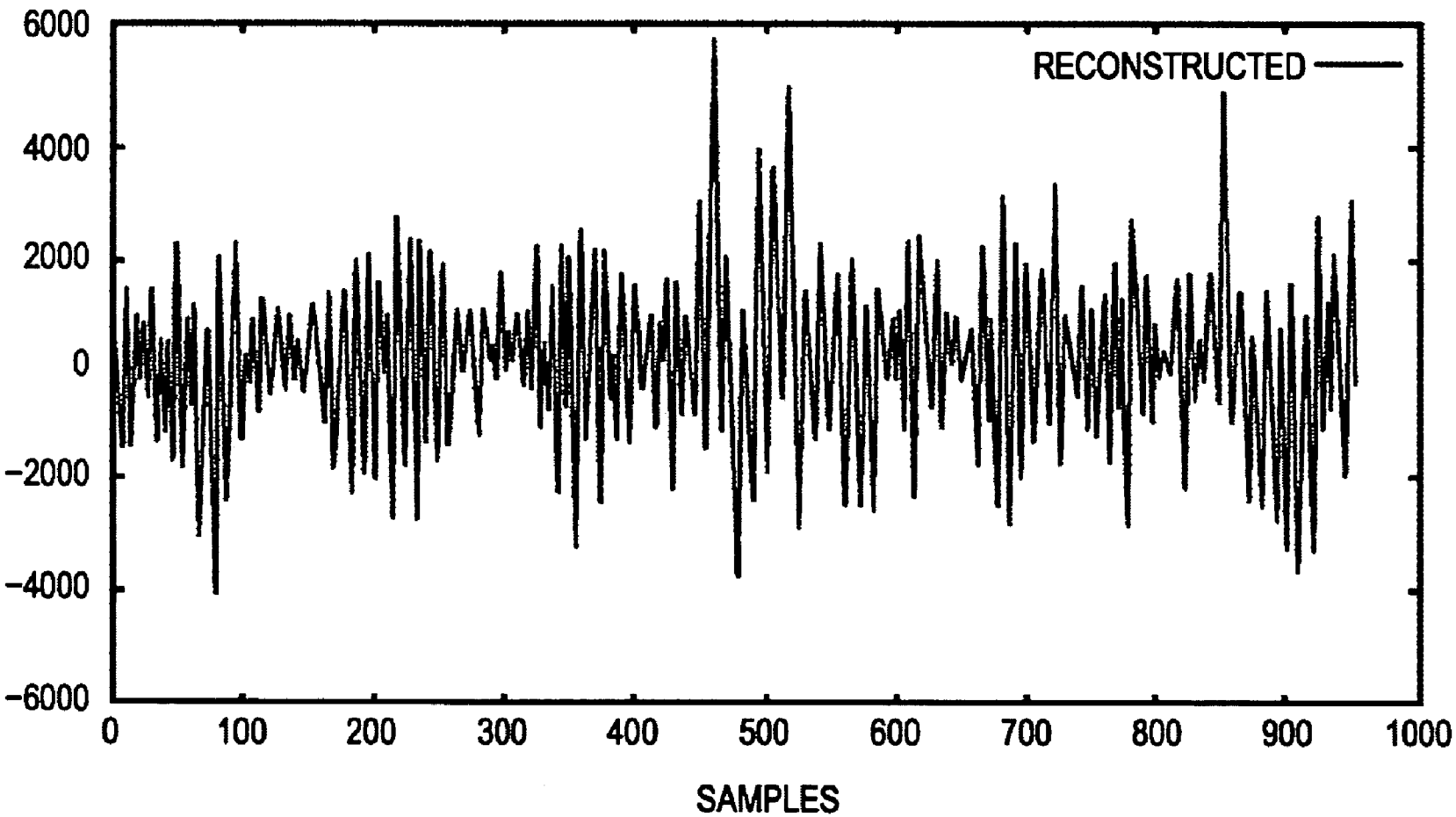
FIG. 27 illustrates an example of a linear predictive synthesized signal.

FIG. 27 illustrates a linear predictive synthesized signal $S_A[n]$ obtained by performing an LPC synthesis process on the synthesized residual signal $r_A[n]$ shown in FIG. 26 using a filter characteristic defined by the linear predictive coefficient $a_i$ (step S102).

Figure 28:
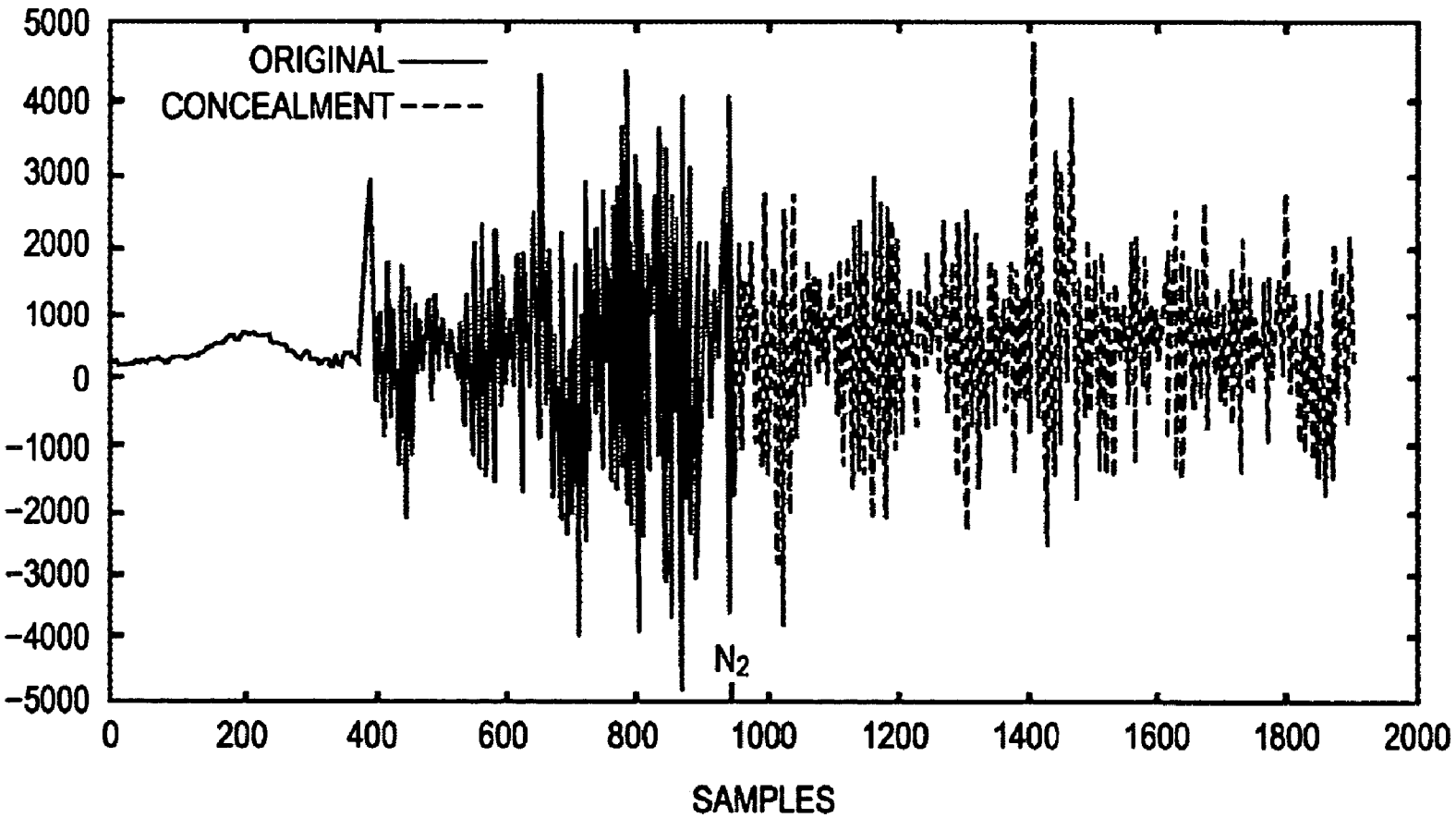
FIG. 28 illustrates an example of an output audio signal.

When a gain-adjusted synthesized signal $S_A'[n]$ obtained by gain-adjusting the linear predictive synthesized signal $S_A[n]$ shown in FIG. 27 (step S103) is concatenated with a normal playback audio signal $S_H[n]$ shown in FIG. 28 at a position indicated by a sample number $N_2$ (steps S28 and S29), an output audio signal shown in FIG. 28 can be obtained.

Even in this case, the signal loss can be concealed. In addition, the waveform of the synthesized signal following the sample number $N_2$ is similar to that of the preceding normal signal. That is, the waveform is similar to that of a natural sounding voice, and therefore, a natural sounding voice can be output.

The reason why the control is performed using the above-described five error states is because five types of different processes are required.

Figure 29:
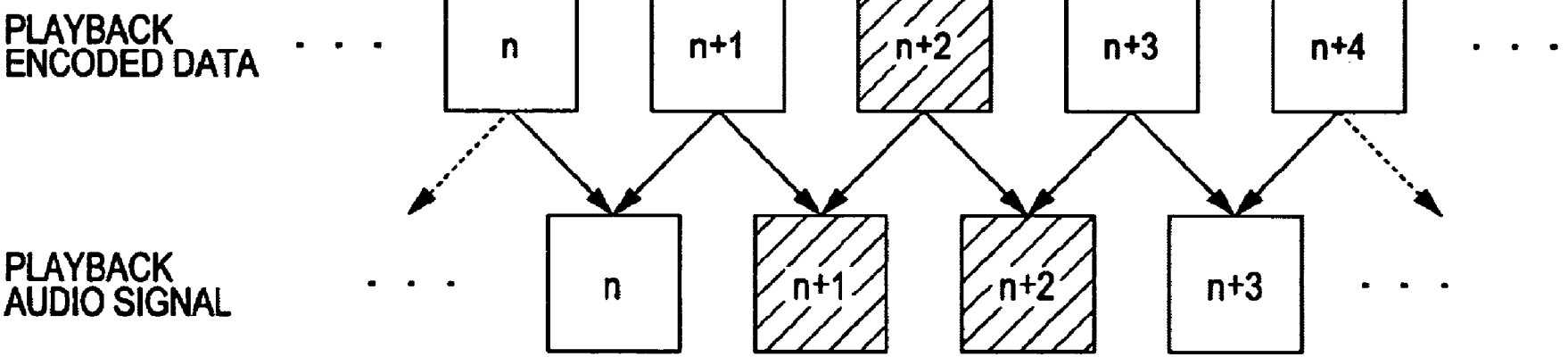
FIG. 29 illustrates a relationship between playback encoded data and a playback audio signal.

The signal decoding unit 35 performs a decoding process shown in FIG. 29. In FIG. 29, the upper section represents time-series playback encoded data. The numbers in blocks indicate the frame numbers. For example, "n" in a block indicates the encoded data of the nth block. Similarly, the lower section represents time-series playback audio data. The numbers in blocks indicate the frame numbers.

The arrow represents the playback encoded data required for generating each of playback audio signals. For example, in order to generate the playback audio signal for the nth frame, the playback encoded data of the nth frame and the (n+1)th frame are required. Accordingly, for example, if a normal playback encoded data of the (n+2)th frame cannot be acquired, a playback audio signal for the two successive frames, that is, the (n+1)th frame and the (n+2)th frame which use the playback encoded data of the (n+2)th frame can not be generated.

According to the present exemplary embodiment of the present invention, by performing the above-described process, the loss of a playback audio signal for two or more successive frames can be concealed.

The state control unit 101 controls itself and the signal analyzing unit 37 so as to cause the signal decoding unit 35 to perform the decoding process shown in FIG. 29. To perform this control, the state control unit 101 has five error states "0", "1", "2", "−1", and "−2" regarding the operations of the signal decoding unit 35, the signal analyzing unit 37, and the state control unit 101 itself.

In the error state "0", the signal decoding unit 35 is operating, and the signal analyzing unit 37 and the signal synthesizing unit 38 are not operating. In the error state "1", the signal decoding unit 35 is not operating, and the signal analyzing unit 37 and the signal synthesizing unit 38 are operating. In the error state "2", the signal decoding unit 35 and the signal analyzing unit 37 are not operating, and the signal synthesizing unit 38 is operating. In the error state "−1", the signal decoding unit 35 and the signal synthesizing unit 38 are operating, and the signal analyzing unit 37 is not operating. In the error state "−2", the signal decoding unit 35 is operating, but does not output a decoded signal, the signal analyzing unit 37 is not operating, and the signal synthesizing unit 38 is operating.

For example, assume that, as shown in FIG. 30, errors sequentially occur in the frames. At that time, the state control unit 101 sets the error status, as shown in FIG. 30. In FIG. 30, a circle indicates that the unit is operating. A cross indicates that the unit is not operating. A triangle indicates that the signal decoding unit 35 performs a decoding operation, but does not output the playback audio signal.

As shown in FIG. 29, the signal decoding unit 35 decodes the playback encoded data for two frames so as to generate a playback audio signal for one frame. This two-frame-based process prevents overload of the signal decoding unit 35. Accordingly, data acquired by decoding the preceding frame is stored in an internal memory. When decoding the playback encoded data of the succeeding frame and acquiring the decoded data, the signal decoding unit 35 concatenates the decoded data with the stored data. Thus, the playback audio signal for one frame is generated. For a frame with a triangle mark, only the first half operation is performed. However, the resultant data is not stored in the signal buffer 36.

The state control unit 101 sets the error status, which represents the state of the state control unit 101, to an initial value of "0" first.

For the zeroth frame and the first frame, the second error flag Fe2 is "0" (i.e., no errors are found). Accordingly, the signal analyzing unit 37 and the signal synthesizing unit 38 do not operate. Only the signal decoding unit 35 operates. The error status remains unchanged to be "0" (step S95). At that time, the output control flag Fco is set to "0" (step S96). Therefore, the switch 39 is switched to the contact point A. Thus, the playback audio signal output from the signal decoding unit 35 is output as an output audio signal.

For the second frame, the second error flag Fe2 is "1" (i.e., an error is found). Accordingly, the error status transits to the error status of "1" (step S86). The signal decoding unit 35 does not operate. The signal analyzing unit 37 analyzes the immediately preceding playback audio signal. Since the immediately preceding error status is "0", it is determined to be "Yes" at step S83. Accordingly, the control flag Fc is set to "1" at step S84. Consequently, the signal synthesizing unit 38 outputs the synthesized audio signal (step S102). At that time, the output control flag Fco is set to "1" (step S107). Therefore, the switch 39 is switched to the contact point B. Thus, the playback audio signal output from the signal synthesizing unit 38 (i.e., the gain-adjusted synthesized signal output through the contact point A of the switch 115 because the error status is not "−1") is output as an output audio signal.

For the third frame, the second error flag Fe2 is "0". Accordingly, the error status transits to the error status of "−2" (step S92). The signal decoding unit 35 operates, but does not output a playback audio signal. The signal synthesizing unit 38 outputs the synthesized audio signal. The signal analyzing unit 37 does not operate. At that time, the output control flag Fco is set to "1" (step S107). Therefore, the switch 39 is switched to the contact point B. Thus, the synthesized audio signal output from the signal synthesizing unit 38 (i.e., the gain-adjusted synthesized signal output through the contact point A of the switch 115 because the error status is not "−1") is output as an output audio signal.

When the error status is "−2", an error is not found in the current frame. Accordingly, the decoding process is performed. However, the decoded signal is not output. Instead, the synthesized signal is output. Since an error is found in the neighboring frame, this operation is performed in order to avoid the affect of the error.

For the fourth frame, the second error flag Fe2 is "0". Accordingly, the error status transits to the error status of "−1" (step S94). The signal decoding unit 35 outputs the playback audio signal, which is mixed with the synthesized audio signal output from the signal synthesizing unit 38. The signal analyzing unit 37 does not operate. At that time, the output control flag Fco is set to "1" (step S107). Therefore, the switch 39 is switched to the contact point B. Thus, the synthesized audio signal output from the signal synthesizing unit 38 (i.e., the synthesized playback audio signal output through the contact point B of the switch 115 because the error status is "−1") is output as an output audio signal.

For the fifth frame, the second error flag Fe2 is "1". Accordingly, the error status transits to the error status of "1" (step S86). The signal decoding unit 35 does not operate. The signal analyzing unit 37 analyzes the immediately preceding playback audio signal. That is, since the immediately preceding error status is "−1", it is determined to be "Yes" at step S83. Accordingly, the control flag Fc is set to "1" at step S84. Consequently, the signal analyzing unit 37 performs the analyzing process. The signal synthesizing unit 38 outputs the synthesized audio signal (step S102). At that time, the output control flag Fco is set to "1" (step S107). Therefore, the switch 39 is switched to the contact point B. Thus, the synthesized audio signal output from the signal synthesizing unit 38 (i.e., the gain-adjusted synthesized signal output through the contact point A of the switch 115 because the error status is not "−1") is output as an output audio signal.

For the sixth frame, the second error flag Fe2 is "1". Accordingly, the error status transits to the error status of "2" (step S89). The signal decoding unit 35 and the signal analyzing unit 37 do not operate. The signal synthesizing unit 38 outputs the synthesized audio signal. At that time, the output control flag Fco is set to "1" (step S107). Therefore, the switch 39 is switched to the contact point B. Thus, the synthesized audio signal output from the signal synthesizing unit 38 (i.e., the gain-adjusted synthesized signal output through the contact point A of the switch 115 because the error status is not "−1") is output as an output audio signal.

For the seventh frame, the second error flag Fe2 is "0". Accordingly, the error status transits to the error status of "−2" (step S92). The signal decoding unit 35 operates, but does not output a playback audio signal. The signal synthesizing unit 38 outputs the synthesized audio signal. The signal analyzing unit 37 does not operate. At that time, the output control flag Fco is set to "1" (step S107). Therefore, the switch 39 is switched to the contact point B. Thus, the synthesized audio signal output from the signal synthesizing unit 38 (i.e., the gain-adjusted synthesized signal output through the contact point A of the switch 115 because the error status is not "−1") is output as an output audio signal.

For the eighth frame, the second error flag Fe2 is "1". Accordingly, the error status transits to the error status of "2" (step S89). The signal decoding unit 35 and the signal analyzing unit 37 do not operate. The signal synthesizing unit 38 outputs the synthesized audio signal. At that time, the output control flag Fco is set to "1" (step S107). Therefore, the switch 39 is switched to the contact point B. Thus, the synthesized audio signal output from the signal synthesizing unit 38 (i.e., the gain-adjusted synthesized signal output through the contact point A of the switch 115 because the error status is not "−1") is output as an output audio signal.

For the ninth frame, the second error flag Fe2 is "0". Accordingly, the error status transits to the error status of "−2" (step S92). The signal decoding unit 35 operates, but does not output a playback audio signal. The signal synthesizing unit 38 outputs the synthesized audio signal. The signal analyzing unit 37 does not operate. At that time, the output control flag Fco is set to "1" (step S107). Therefore, the switch 39 is switched to the contact point B. Thus, the synthesized audio signal output from the signal synthesizing unit 38 (i.e., the gain-adjusted synthesized signal output through the contact point A of the switch 115 because the error status is not "−1") is output as an output audio signal.

For the tenth frame, the second error flag Fe2 is "0". Accordingly, the error status transits to the error status of "−1" (step S94). The signal decoding unit 35 outputs the playback audio signal, which is mixed with the synthesized audio signal output from the signal synthesizing unit 38. The signal analyzing unit 37 does not operate. At that time, the output control flag Fco is set to "1" (step S107) Therefore, the switch 39 is switched to the contact point B. Thus, the synthesized audio signal output from the signal synthesizing unit 38 (i.e., the synthesized playback audio signal output through the contact point B of the switch 115 because the error status is "−1") is output as an output audio signal.

For the eleventh frame, the second error flag Fe2 is "0". Accordingly, the error status transits to the error status of "0" (step S86). The signal analyzing unit 37 and the signal synthesizing unit 38 do not operate. Only the signal decoding unit 35 operates. At that time, the output control flag Fco is set to "0" (step S96). Therefore, the switch 39 is switched to the contact point A. Thus, the playback audio signal output from the signal decoding unit 35 is output as an output audio signal.

In summary:

(a) The signal decoding unit 35 operates when the second error flag Fe2 is "0" (when the error status is less than or equal to "0"). However, the signal decoding unit 35 does not output the playback audio signal when the error status is "−2".

(b) The signal analyzing unit 37 operates only when the error status is "1".

(c) The signal synthesizing unit 38 operates when the error status is not "0". When the error status is "−1", the signal synthesizing unit 38 mixes the playback audio signal with the synthesized audio signal and outputs the mixed signal.

As described above, by concealing the loss of the playback audio signal, unpleasant sound that makes users feel irritated can be reduced.

In addition, the configuration of the state control unit 101 may be changed so that the process for a frame does not give any impact to the process of another frame.

While the exemplary embodiments above have been described with reference to a packet voice communication system, the exemplary embodiments are applicable to cell phones and a variety of types of signal processing apparatuses. In particular, when the above-described functions are realized using software, the exemplary embodiments can be applied to a personal computer by installing the software in the personal computer.

Figure 31:
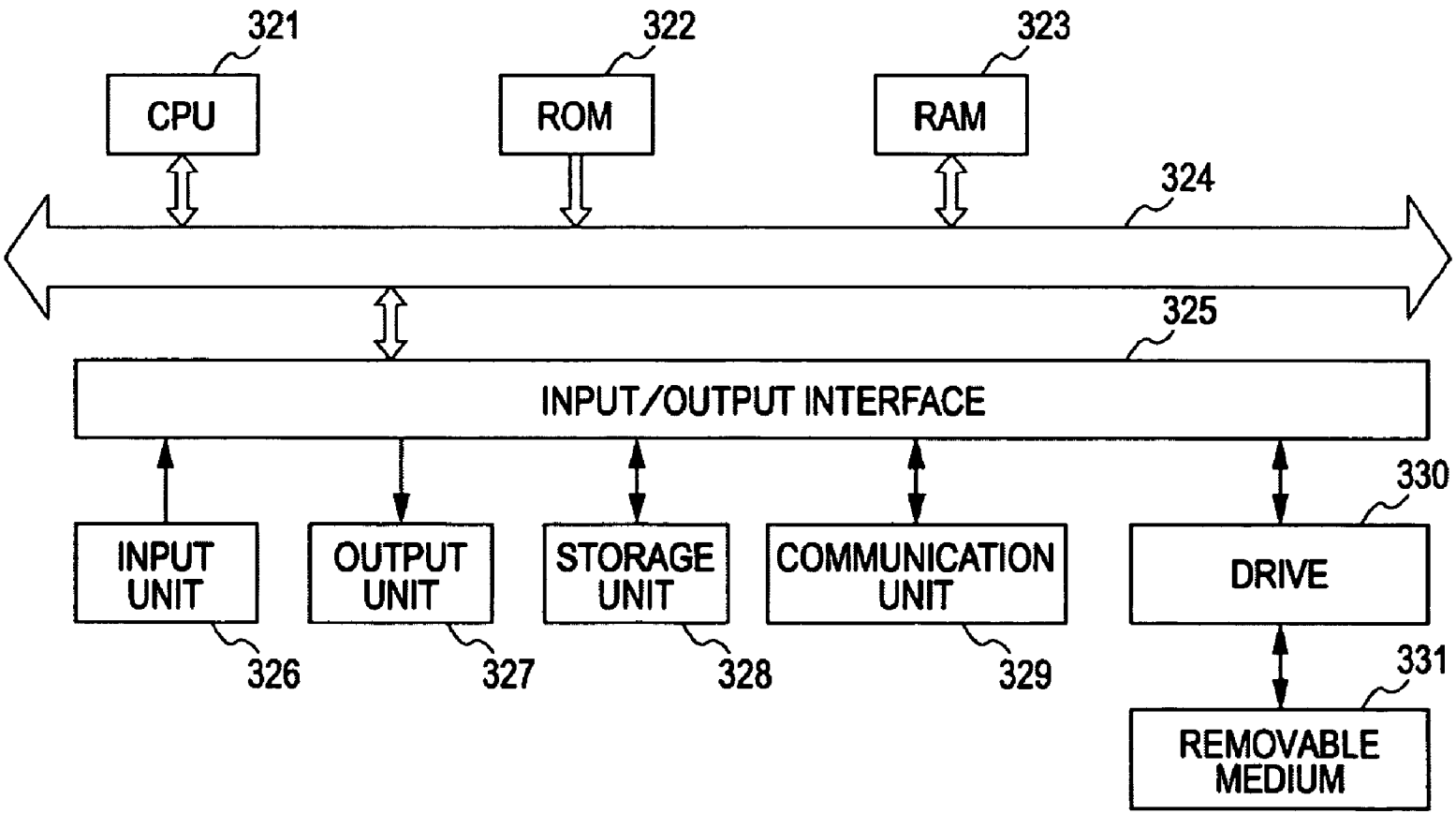
FIG. 31 is a block diagram of an exemplary configuration of a personal computer.

FIG. 31 is a block diagram of the hardware configuration of a personal computer 311 that executes the above-described series of processes using a program. A central processing unit (CPU) 321 executes the above-described processes and the additional processes in accordance with the program stored in a read only memory (ROM) 322 or a storage unit 328. A random access memory (RAM) 323 stores the program executed by the CPU 321 or data as needed. The CPU 321, the ROM 322, and the RAM 323 are connected to each other via a bus 324.

In addition, an input/output interface 325 is connected to the CPU 321 via the bus 324. An input unit 326 including a keyboard, a mouse, and a microphone and an output unit 327 including a display and a speaker are connected to the input/output interface 325. The CPU 321 executes a variety of processes in response to a user instruction input from the input unit 326. Subsequently, the CPU 321 outputs the processing result to the output unit 327.

The storage unit 328 is connected to the input/output interface 325. The storage unit 328 includes, for example, a hard disk. The storage unit 328 stores the program executed by the CPU 321 and a variety of data. A communication unit 329 communicates with an external apparatus via a network, such as the Internet and a local area network. The program may be acquired via the communication unit 329, and the acquired program may be stored in the storage unit 328.

A drive 330 is connected to the input/output interface 325. When a removable medium 331, such as a magnetic disk, an optical disk, a magnetooptical disk, or a semiconductor memory, is mounted on the drive 330, the drive 330 drives the removable medium 331 so as to acquire a program or data recorded on the removable medium 331. The acquired program and data are transferred to the storage unit 328 as needed. The storage unit 328 stores the transferred program and data.

In the case where the above-described series of processes are performed using software, a program serving as the software is stored in a program recording medium. Subsequently, the program is installed, from the program recording medium, in a computer embedded in dedicated hardware or a computer, such as a general-purpose personal computer, that can perform a variety of processes when a variety of programs are installed therein.

The program recording medium stores a program that is installed in a computer so as to be executable by the computer. As shown in FIG. 31, examples of the program recording medium include a magnetic disk (including a flexible disk), an optical disk, such as a CD-ROM (compact disk-read only memory), a DVD (digital versatile disc), and a magnetooptical disk, the removable medium 331 serving as packaged medium composed of semiconductor memories, the ROM 322 that temporarily or permanently stores a program, and a hard disk serving as the storage unit 328. The program is stored in the program recording medium via the communication unit 329 (e.g., a router or a modem) using a wired or wireless communication medium, such as a local area network, the Internet, or digital satellite-based broadcasting.

In the present specification, the steps that describe the program stored in the recording media include not only processes executed in the above-described sequence, but also processes that may be executed in parallel or independently.

In addition, as used in the present specification, the term "system" refers to a logical combination of a plurality of apparatuses.

It should be understood by those skilled in the art that various modifications, combinations, sub-combinations and alterations may occur depending on design requirements and other factors insofar as they are within the scope of the appended claims or the equivalents thereof.

What is claimed is:

1. A signal processing apparatus comprising:

a decoder for decoding an input encoded audio signal and outputting a playback audio signal;

an analyzing unit for generating a linear predictive residual signal when loss of the encoded signal occurs, by analyzing the playback audio signal output before the loss occurs;

a synthesizing unit comprising:

a noise-like residual signal generator for generating a noise-like residual signal having a randomly varying phase from the linear predictive residual signal;

a periodic residual signal generator for generating a periodic residual signal by repeating the linear predictive residual signal in accordance with a pitch period of the linear predictive residual signal; and a synthesizer for generating a synthesized audio signal by combining the noise-like residual signal and the periodic residual signal in predetermined proportions; and a switch for selecting one of the synthesized audio signal and the playback audio signal and outputting the selected audio signal as a continuous output audio signal.

2. The signal processing apparatus according to claim 1, wherein the analyzing unit includes:

a linear predictive residual signal generator for generating the linear predictive residual signal serving as a feature parameter; and a parameter generator for generating, from the linear predictive residual signal, a first feature parameter serving as a different feature parameter, and wherein the synthesizing unit generates the synthesized audio signal on the basis of the first feature parameter.

3. The signal processing apparatus according to claim 2, wherein the linear predictive residual signal generator further generates a second feature parameter, and wherein the synthesizing unit generates the synthesized audio signal on the basis of the first feature parameter and the second feature parameter.

4. The signal processing apparatus according to claim 3, wherein the linear predictive residual signal generator computes a linear predictive coefficient serving as the second feature parameter, and wherein the parameter generator includes;

a filter for filtering the linear predictive residual signal; and a pitch extractor for generating a pitch period and pitch gain as the first feature parameter, and wherein the pitch period is determined to be an amount of delay of the filtered linear predictive residual signal when the autocorrelation of the filtered linear predictive residual signal is maximized, and the pitch gain is determined to be the autocorrelation.

5. The signal processing apparatus according to claim 4, wherein the synthesizing unit includes;

a synthesized linear predictive residual signal generator for generating a synthesized linear predictive residual signal from the linear predictive residual signal; and a synthesized signal generator for generating a linear predictive synthesized signal to be output as the synthesized audio signal by filtering the synthesized linear predictive residual signal in accordance with a filter property defined by the second feature parameter.

6. The signal processing apparatus according to claim 1, further comprising:

a decomposing unit for supplying the encoded audio signal obtained by decomposing the received packet to the decoder.

7. The signal processing apparatus according to claim 1, wherein the synthesizing unit includes a controller for controlling the operations of the decoder, the analyzing unit, and the synthesizing unit itself depending on the presence or absence of an error in the audio signal.

8. The signal processing apparatus according to claim 7, wherein, when an error affects the processing of another audio signal, the controller performs control so that the synthesized audio signal is output in place of the playback audio signal even when an error is not present.

9. A signal processing apparatus comprising:

a decoder for decoding an input encoded audio signal and outputting a playback audio signal;

an analyzing unit for generating a linear predictive residual signal when loss of the encoded signal occurs, by analyzing the playback audio signal output before the loss occurs, the analyzing unit comprising:

a linear predictive residual signal generator for generating the linear predictive residual signal serving as a feature parameter, and for computing a linear predictive coefficient serving as a second parameter;

a filter for filtering the linear predictive residual signal; and a pitch extractor for generating a pitch period and pitch gain as the first feature parameter, and wherein the pitch period is determined to be an amount of delay of the filtered linear predictive residual signal when the autocorrelation of the filtered linear predictive residual signal is maximized, and the pitch gain is determined to be the autocorrelation;

a synthesizing unit comprising:

a noise-like residual signal generator for generating a noise-like residual signal having a randomly varying phase from the linear predictive residual signal;

a periodic residual signal generator for generating a periodic residual signal by repeating the linear predictive residual signal, in accordance with the pitch period; and a synthesized linear predictive residual signal generator for generating a synthesized linear predictive residual signal by combining the noise-like residual signal and the periodic residual signal in predetermined proportions on the basis of the first feature parameter; and a synthesized signal generator for generating a linear predictive synthesized signal to be output as the synthesized audio signal by filtering the synthesized linear predictive residual signal in accordance with a filter property defined by the second feature parameter; and a switch for selecting one of the synthesized audio signal and the playback audio signal and outputting the selected audio signal as a continuous output audio signal.

10. The signal processing apparatus according to claim 9, wherein the noise-like residual signal generator includes:

a Fourier transforming unit for performing a fast Fourier transform on the linear predictive residual signal so as to generate a Fourier spectrum signal;

a smoothing unit for smoothing the Fourier spectrum signal;

a noise-like spectrum generator for generating a noise-like spectrum signal by adding different phase components to the smoothed Fourier spectrum signal; and an inverse fast Fourier transforming unit for performing an inverse fast Fourier transform on the noise-like spectrum signal so as to generate the noise-like residual signal.

11. The signal processing apparatus according to claim 9, wherein the synthesized residual signal generator includes:

a first multiplying unit for multiplying the noise-like residual signal by a first coefficient determined by the pitch gain;

a second multiplying unit for multiplying the periodic residual signal by a second coefficient determined by the pitch gain; and an adding unit for summing the noise-like residual signal multiplied by the first coefficient and the periodic residual signal multiplied by the second coefficient, to obtain a synthesized residual signal and for outputting the obtained synthesized residual signal as the synthesized linear predictive residual signal.

12. The signal processing apparatus according to claim 9, wherein, when the pitch gain is smaller than a reference value, the periodic residual signal generator generates the periodic residual signal by reading out the linear predictive residual signal at random positions thereof.

13. The signal processing apparatus according to claim 5, wherein the synthesizing unit further includes a gain-adjusted synthesized signal generator for generating a gain-adjusted synthesized signal by multiplying the linear predictive synthesized signal by a coefficient that varies in accordance with an error status value or an elapsed time of an error state of the encoded audio signal.

14. The signal processing apparatus according to claim 13, wherein the synthesizing unit further includes:

a synthesized playback audio signal generator for generating a synthesized playback audio signal by summing the playback audio signal and the gain-adjusted synthesized signal in predetermined proportions; and a selector for selecting one of the synthesized playback audio signal and the gain-adjusted synthesized signal and outputting the selected one as the synthesized audio signal.

15. A method for processing a signal, comprising the steps of:

decoding, using a processor, an input encoded audio signal and outputting a playback audio signal;

when loss of the encoded audio signal occurs, analyzing, using a processor, the playback audio signal output before the loss occurs and generating a linear predictive residual signal;

generating a noise-like residual signal having a randomly varying phase from the linear predictive residual signal;

generating a periodic residual signal by repeating the linear predictive residual signal in accordance with a pitch period of the linear predictive residual signal;

synthesizing, using a processor, a synthesized audio signal by combining the noise-like residual signal and the periodic residual signal in predetermined proportions; and selecting, using a processor, one of the synthesized audio signal and the playback audio signal and outputting the selected audio signal as a continuous output audio signal.

16. A non-transitory computer-readable storage medium storing program comprising program code for causing a computer to perform the steps of:

decoding an input encoded audio signal and outputting a playback audio signal;

when loss of the encoded audio signal occurs, analyzing the playback audio signal output before the loss occurs and generating a linear predictive residual signal;

generating a noise-like residual signal having a randomly varying phase from the linear predictive residual signal;

generating a periodic residual signal by repeating the linear predictive residual signal in accordance with a pitch period of the linear predictive residual signal;

synthesizing a synthesized audio signal by combining the noise-like residual signal and the periodic residual signal in predetermined proportions; and selecting one of the synthesized audio signal and the playback audio signal and outputting the selected audio signal as a continuous output audio signal.

17. A signal processing apparatus comprising:

a decoder configured to decode an input encoded audio signal and output a playback audio signal;

an analyzing unit for generating a linear predictive residual signal when loss of the encoded signal occurs, by analyzing the playback audio signal output before the loss occurs;

a synthesizing unit comprising:

a noise-like residual signal generator for generating a noise-like residual signal having a randomly varying phase from the linear predictive residual signal;

a periodic residual signal generator for generating a periodic residual signal by repeating the linear predictive residual signal in accordance with a pitch period of the linear predictive residual signal; and a synthesizer for generating a synthesized audio signal by combining the noise-like residual signal and the periodic residual signal in predetermined proportions; and a switch configured to select one of the synthesized audio signal and the playback audio signal and output the selected audio signal as a continuous output audio signal.

* * * * *